US012084774B2

(12) United States Patent
Yamashiro et al.

(10) Patent No.: US 12,084,774 B2
(45) Date of Patent: Sep. 10, 2024

(54) GAS WIPING NOZZLE AND METHOD FOR MANUFACTURING HOT-DIP METAL COATED METAL STRIP

(71) Applicant: JFE STEEL CORPORATION, Tokyo (JP)

(72) Inventors: Kenji Yamashiro, Tokyo (JP); Hideyuki Takahashi, Tokyo (JP); Takumi Koyama, Tokyo (JP); Hidetoshi Inoue, Tokyo (JP); Syuhei Nishinaka, Tokyo (JP); Toshiki Fujii, Tokyo (JP); Reona Aishima, Tokyo (JP); Yutaka Yanagisawa, Tokyo (JP); Masahiro Yoshikawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 92 days.

(21) Appl. No.: 18/008,487

(22) PCT Filed: Apr. 21, 2021

(86) PCT No.: PCT/JP2021/016193
§ 371 (c)(1),
(2) Date: Dec. 6, 2022

(87) PCT Pub. No.: WO2021/256079
PCT Pub. Date: Dec. 23, 2021

(65) Prior Publication Data

US 2023/0212728 A1 Jul. 6, 2023

(30) Foreign Application Priority Data

Jun. 19, 2020 (JP) ..... 2020-105965

(51) Int. Cl.
*C23C 2/00* (2006.01)
*C23C 2/20* (2006.01)
*C23C 2/40* (2006.01)

(52) U.S. Cl.
CPC . *C23C 2/20* (2013.01); *C23C 2/40* (2013.01)

(58) Field of Classification Search
CPC .. C23C 2/003; C23C 2/20; C23C 2/40; C23C 2/14; C23C 2/16; C23C 2/18; C23C 2/50; C23C 2/52
See application file for complete search history.

(56) References Cited

U.S. PATENT DOCUMENTS

2020/0171513 A1 6/2020 Nishimura et al.
2022/0136090 A1 5/2022 Terasaki et al.

FOREIGN PATENT DOCUMENTS

EP 3205741 A1 8/2017
JP H8-176776 A 7/1996
(Continued)

OTHER PUBLICATIONS

JP-2010285668-A English translation. (Year: 2010).*
(Continued)

*Primary Examiner* — Hai Y Zhang
(74) *Attorney, Agent, or Firm* — Oliff PLC

(57) ABSTRACT

A gas wiping nozzle manufactured from parts divided along the slit length direction and maintains a gap in the width direction over the length direction in high temperature atmospheres and a method for manufacturing a hot-dip metal strip. In a gas wiping nozzle, a first and a second nozzle member are each divided along the length direction X of a slit into a plurality of nozzle members. The dimension of a divided face of the first nozzle member is 1.5T1 or more in a section of the first nozzle member where T1 is the thickness of the first nozzle member in the width direction
(Continued)

Z of the slit, and the dimension of a divided face of the second nozzle member is 1.5T2 or more in a section of the second nozzle member where T2 is the thickness of the second nozzle member in the width direction Z of the slit.

17 Claims, 9 Drawing Sheets

(56) References Cited

FOREIGN PATENT DOCUMENTS

| | | | | | |
|---|---|---|---|---|---|
| JP | 2010285668 | A | * | 12/2010 | ..... C23C 2/20 |
| JP | 6011740 | B2 | | 10/2016 | |
| JP | 2017-222923 | A | | 12/2017 | |
| JP | 2018-178159 | A | | 11/2018 | |
| JP | 6702519 | B1 | | 6/2020 | |
| WO | WO-2019065453 | A1 | * | 4/2019 | ..... B05B 1/005 |

OTHER PUBLICATIONS

WO-2019065453-A1 English translation. (Year: 2019).*
Dec. 13, 2023 International Preliminary Report on Patentability Issued in International Patent Application No. PCT/JP2021/016193.
Jun. 22, 2021 International Search Report Issued in International Patent Application No. PCT/JP2021/016193.
Feb. 15, 2023 Extended Search Report issued in European Patent Application No. 21825278.1.

* cited by examiner

GAS WIPING NOZZLE AND METHOD FOR MANUFACTURING HOT-DIP METAL COATED METAL STRIP

TECHNICAL FIELD

The present invention relates to a gas wiping nozzle that blows gas onto a metal strip pulled up from a molten metal bath and adjusts the amount of a molten metal coated to a surface of the metal strip and a method for manufacturing a hot-dip metal coated metal strip using the gas wiping nozzle.

BACKGROUND ART

A hot-dip galvanized steel sheet, which is a type of hot-dip metal coated steel sheets, is widely used in fields such as building materials, automobiles, and home appliances. In these applications, an excellent appearance is required for the hot-dip galvanized steel sheet. Here, since the appearance after painting is strongly affected by surface defects such as uneven coating thickness, flaws, and adhesion of foreign matter, it is important that the hot-dip galvanized steel sheet has no surface defects.

In a continuous hot-dip metal coating line, normally, a steel strip as a metal strip annealed in a continuous annealing furnace in a reducing atmosphere passes through a snout and is introduced into a molten metal bath in a coating tank. The steel strip is pulled up above the molten metal bath via a sink roll and a support roll in the molten metal bath. Thereafter, the amount (hereinafter, also referred to as a basic weight amount) of molten metal coated is adjusted by blowing wiping gas from gas wiping nozzles located on both sides of the steel strip onto the surface of the steel strip and scraping off the excess molten metal coated to the surface of the steel strip and pulled up. Here, in order to correspond to various steel strip widths and also to cope with displacement in the width direction when the steel strip is pulled up, the gas wiping nozzle is normally configured to be wider than the width of the steel strip and extends outward from an end portion in the width direction of the steel strip.

In such a gas wiping method, hot metal wrinkles (also referred to as hot metal sagging) with corrugated flow pattern are often generated on the coated surface due to minute vibration of the steel strip or irregular hot metal flow on the coating layer due to the blowing of wiping gas. In a case where the coated surface of a coated steel sheet with such hot metal wrinkles is used as a coating base surface in an outer coating application, a surface texture of a coating film, particularly smoothness, is impaired, and thus the coated steel sheet cannot be used for an exterior sheet to be suitable for a coating treatment having an excellent appearance, which significantly affects the yield of the coated steel sheet.

In order to solve this problem, in the related art, for example, those described in PTL 1 are known.

A continuous hot-dip metal coating method described in PTL 1 is a method in which a steel strip is continuously immersed in a molten metal coating bath, and gas is blown from a gas wiping nozzle onto the steel strip immediately after being drawn out from the molten metal coating bath to control the amount of coating. The temperature T of the wiping gas blown from the gas wiping nozzle is controlled according to a D/B value represented by a ratio of the distance D between a tip end of the gas wiping nozzle and the steel strip, and a gas wiping nozzle gap B.

In addition, in the gas wiping method in the related art, a phenomenon that the edge portion of the steel strip may be supercooled from a central portion occurs during wiping, the steel strip may be warped, the amount of coating in the width direction may be uneven, and there may also be a problem of wasting a large amount of zinc in vain to guarantee the lower limit of the amount of zinc coated.

In order to solve this problem, for example, a method described in PTL 2 is known in the related art.

A wiping method in continuous hot-dip galvanizing described in PTL 2 is a method of heating wiping gas such that the temperature $T_G$ (° C.) of the wiping gas and the sheet thickness D (mm) of a steel strip to be coated satisfy the following equation (1), in the continuous hot-dip galvanizing, when the wiping gas is blown from a gas wiping nozzle to wipe the hot-dip zinc coating to the front and rear of the steel strip to be coated.

$$\text{Wiping gas temperature } T_G(^\circ\text{ C.}) \geq -400D+400 \quad (1)$$

In addition, as the gas wiping nozzle in the related art, for example, a nozzle described in PTL 3 is also known.

The gas wiping nozzle described in PTL 3 is a nozzle that blows gas onto a steel strip pulled up above a molten metal coating bath and adjusts a film thickness of a molten metal film coated to the surface of the steel strip. The gas wiping nozzle includes a first lip portion and a second lip portion that are provided so as to face each other and form a nozzle chamber into which gas is introduced, a slit formed between the end portions of the first lip portion and the second lip portion on the steel strip side, as a blowing port for gas blown from the nozzle chamber, and a fixing member provided on the slit side in the nozzle chamber and fixing the first lip portion and the second lip portion. In the fixing member, a plurality of first communication holes that communicate the slit side and the opposite side of the slit with respect to the fixing member is disposed side by side along the width direction of the steel strip.

According to the gas wiping nozzle described in PTL 3, even in a case where each part is reassembled in order to replace a part or all of the parts constituting the gas wiping nozzle, it is possible to suppress variations in a gap of the slit (hereinafter, also referred to as a slit gap) after assembly for each assembly.

CITATION LIST

Patent Literature

PTL 1: Japanese Patent No. 6011740
PTL 2: JP H8-176776 A
PTL 3: JP 2018-178159 A

SUMMARY OF INVENTION

Technical Problem

However, the continuous hot-dip metal coating method described in PTL 1, the wiping method in the continuous hot-dip galvanizing described in PTL 2, and the gas wiping nozzle described in PTL 3 in the related art have the following problems.

In other words, in the continuous hot-dip metal coating method described in PTL 1 and the wiping method in the continuous hot-dip galvanizing described in PTL 2, a wiping gas is heated, and accordingly the periphery of the gas wiping nozzle becomes a high temperature atmosphere. The gas wiping nozzle itself is also heated as the wiping gas is heated. PTL 1 and PTL 2 do not describe whether the gas wiping nozzle is manufactured as a monobloc product in the length direction of the slit as a gas blowing port that is provided at the steel strip-side end of the gas wiping nozzle or is manufactured from divided parts. A gas wiping nozzle may be difficult to manufacture as a monobloc product depending on the material of the gas wiping nozzle, and may be manufactured from parts divided along the slit length direction. When a gas wiping nozzle is manufactured from parts divided along the slit length direction, and the periphery of the gas wiping nozzle becomes a high temperature atmosphere, the slit as the gas blowing port may have uneven gaps in the width direction orthogonal to the length direction depending on the assembling manner of the gas wiping nozzle, and a steel strip may have uneven coating amounts in the width direction of the steel strip, unfortunately.

In the gas wiping nozzle disclosed in PTL 3, a first lip portion and a second lip portion are fixed with a fixing member at the slit side in a nozzle chamber, and thus the slit gap can be prevented from varying after each assembly when some or all parts included in the gas wiping nozzle are exchanged.

In the gas wiping nozzle disclosed in PTL 3, however, each of the upper first lip portion and the second lip portion is manufactured as a monobloc product in the length direction of the slit as the gas blowing port, and each of the first lip portion and the second lip portion is not manufactured from parts divided along the slit length direction. Manufacturing each of the first lip portion and the second lip portion from parts divided along the slit length direction should cause a similar problem to that when the above gas wiping nozzle is manufactured from parts divided along the slit length direction.

The present invention is therefore intended to solve the related art problems and to provide a gas wiping nozzle that is manufactured from parts divided along the length direction of a slit as a gas blowing port, maintains a gap to be constant in the width direction orthogonal to the length direction of the slit over the length direction of the slit even in a high temperature atmosphere, and makes the coating amount on a steel strip constant in the width direction of the steel strip and a method for manufacturing a hot-dip metal strip using the gas wiping nozzle.

Solution to Problem

To solve the problems, a gas wiping nozzle pertaining to an aspect of the present invention is configured to blow a wiping gas onto a metal strip pulled up from a molten metal bath and adjust an amount of a molten metal coated to a surface of the metal strip. The gas wiping nozzle includes a first nozzle member and a second nozzle member, and has a slit as a gas blowing port between the first nozzle member and the second nozzle member, at a metal strip side end of the gas wiping nozzle. Each of the first nozzle member and the second nozzle member is divided along the length direction of the slit into a plurality of nozzle members, the dimension of a divided face of the first nozzle member is 1.5T1 or more in a section of the first nozzle member that is cut in the length direction of the slit, at at least one point on the depth direction orthogonal to the length direction of the slit where T1 is the thickness of the first nozzle member in the width direction of the slit, and the dimension of a divided face of the second nozzle member is 1.5T2 or more in a section of the second nozzle member that is cut in the length direction of the slit, at at least one point on the depth direction orthogonal to the length direction of the slit where T2 is the thickness of the second nozzle member in the width direction of the slit.

A method for manufacturing a hot-dip metal coated metal strip pertaining to another aspect of the present invention includes disposing a pair of the gas wiping nozzles described above on both surface sides of a metal strip pulled up from a molten metal bath, and blowing wiping gas from each slit of the pair of gas wiping nozzles to each surface of the metal strip to adjust an amount of molten metal coated to both surfaces of the metal strip, continuously manufacturing a hot-dip metal coated metal strip.

Advantageous Effects of Invention

According to the gas wiping nozzle and the method for manufacturing a hot-dip metal coated metal strip pertaining to the present invention, a gas wiping nozzle that is manufactured from parts divided along the length direction of a slit as a gas blowing port, maintains a gap to be constant in the width direction orthogonal to the length direction of the slit over the length direction of the slit even in a high temperature atmosphere, and makes the coating amount on a steel strip constant in the width direction of the steel strip and a method for manufacturing a hot-dip metal strip using the gas wiping nozzle can be provided.

DESCRIPTION OF EMBODIMENTS

Hereinafter, embodiments of the present invention will be now described with reference to the drawings. The embodiments illustrated below exemplify devices and methods for embodying the technical idea of the present invention, and the technical idea of the present invention does not specify the material, shape, structure, arrangement, and the like of the component parts in the following embodiments.

In addition, the drawings are schematic. Therefore, it should be noted that a relationship, ratio, and the like between a thickness and a plane dimension are different from the actual ones, and there are parts where the relationship and ratio of the dimensions are different between the drawings.

Figure 1:
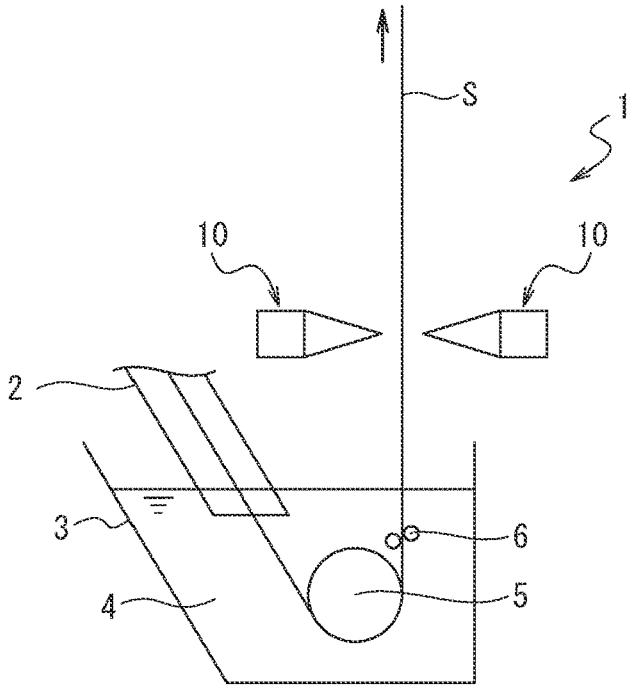
FIG. 1 is a schematic view illustrating a schematic configuration of continuous hot-dip metal coating equipment provided with a gas wiping nozzle according to an embodiment of the present invention.

FIG. 1 illustrates a schematic configuration of continuous hot-dip metal coating equipment provided with a gas wiping nozzle according to an embodiment of the present invention.

The continuous hot-dip metal coating equipment 1 illustrated in FIG. 1 is equipment for continuously coating molten metal to the surface of a steel strip S as a metal strip by immersing the steel strip S in a molten metal bath 4 made of the molten metal, and then bringing the molten metal into a predetermined amount of coating.

The continuous hot-dip metal coating equipment 1 includes a snout 2, a coating tank 3, a sink roll 5, and a support roll 6.

The snout 2 is a member having a rectangular cross section perpendicular to the traveling direction of the steel strip S, which partitions a space through which the steel strip S passes. The upper end of the snout 2 is connected to, for example, the outlet side of a continuous annealing furnace, and the lower end is immersed in the molten metal bath 4 stored in the coating tank 3. In the present embodiment, the steel strip S annealed in the continuous annealing furnace in a reducing atmosphere passes through the snout 2 and is continuously introduced into the molten metal bath 4 in the coating tank 3. Thereafter, the steel strip S is pulled upward from the molten metal bath 4 via the sink roll 8 and the support roll 6 in the molten metal 4.

Wiping gas is blown onto both surfaces of the steel strip S pulled upward from the molten metal bath 4 from a pair of gas wiping nozzles 10 (slits 14 described later) disposed on both surface sides of the steel strip S and the amount of molten metal coated to both surfaces of the steel strip S is adjusted. Thereafter, the steel strip S is cooled by cooling equipment (not illustrated) and guided to a subsequent step, and the hot-dip metal coated steel strip S is continuously manufactured.

Figure 2:
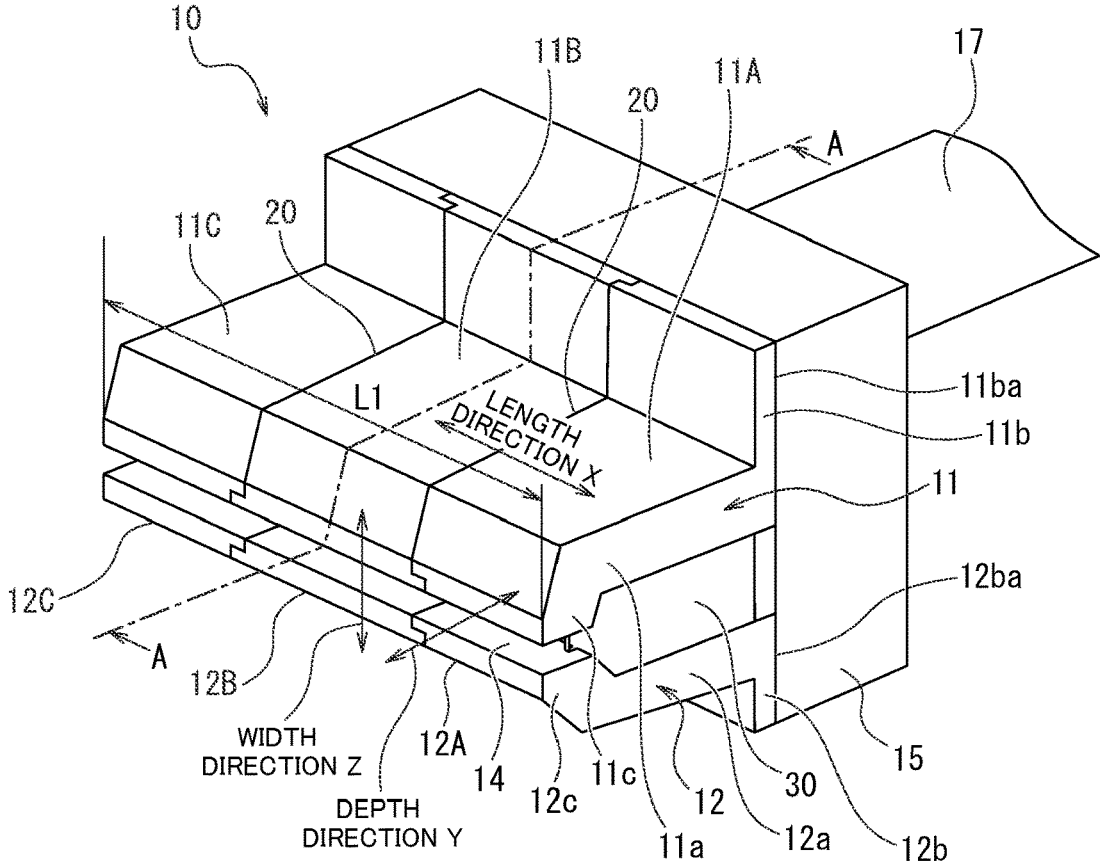
FIG. 2 is a perspective view illustrating a schematic configuration of the gas wiping nozzle used in the continuous hot-dip metal coating equipment illustrated in FIG. 1.

Here, each of the pair of gas wiping nozzles 10 disposed on both surface sides of the steel strip S includes a nozzle header 15 and a first nozzle member 11 disposed on the upper side and a second nozzle member 12 disposed on the lower side that are connected to the nozzle header 15, as illustrated in FIG. 2. The first nozzle member 11 and the second nozzle member 12 are provided to face each other, and the slit 14 as a gas blowing port is formed so as to extend elongated in the length direction X between the end portions 11*c* and 12*c*, on the steel strip S side, of the first nozzle member 11 and the second nozzle member 12. Each gas wiping nozzle 10 is disposed on each surface side of the steel strip S so that the length direction X of the slit 14 is along the sheet width direction of the steel strip S, the width direction Z orthogonal to the length direction X of the slit 14 is along the sheet length direction of the steel strip S, and the depth direction Y of the slit 14 is along the sheet thickness direction of the steel strip S. The width direction Z of the slit is the same as the vertical direction of the gas wiping nozzle 10. The wiping gas is blown from the slit 14 toward one surface of the steel strip S from one of the gas wiping nozzles 10. In addition, the wiping gas is blown from the slit 14 toward the other surface of the steel strip S from the other gas wiping nozzle 10. As a result, excess molten metal is scraped off on both surfaces of the steel strip S, the amount of coating (molten metal) is adjusted, and the amount of coating is made uniform in the sheet width direction and the sheet length direction of the steel strip S. In order to correspond to various sheet widths of steel strip S and to cope with displacement in the width direction when the steel strip S is pulled up, each gas wiping nozzle 10 is configured to be longer than the sheet width of steel strip S so that the length of the slit 14 is longer than the sheet width of steel strip S, and extends outward from an end portion of the steel strip S in the width direction.

The nozzle header 15 of each gas wiping nozzle 10 is formed in an approximately rectangular shape extending in the length direction X, the depth direction Y, and the width direction Z and is made from a metal such as chrome molybdenum steel. To the base end (rear end) of the nozzle header 15, a gas supply pipe 17 is connected, and a gas supply path 16 communicating the gas supply pipe 17 with a hollow portion 13 described later is formed.

Figure 3:
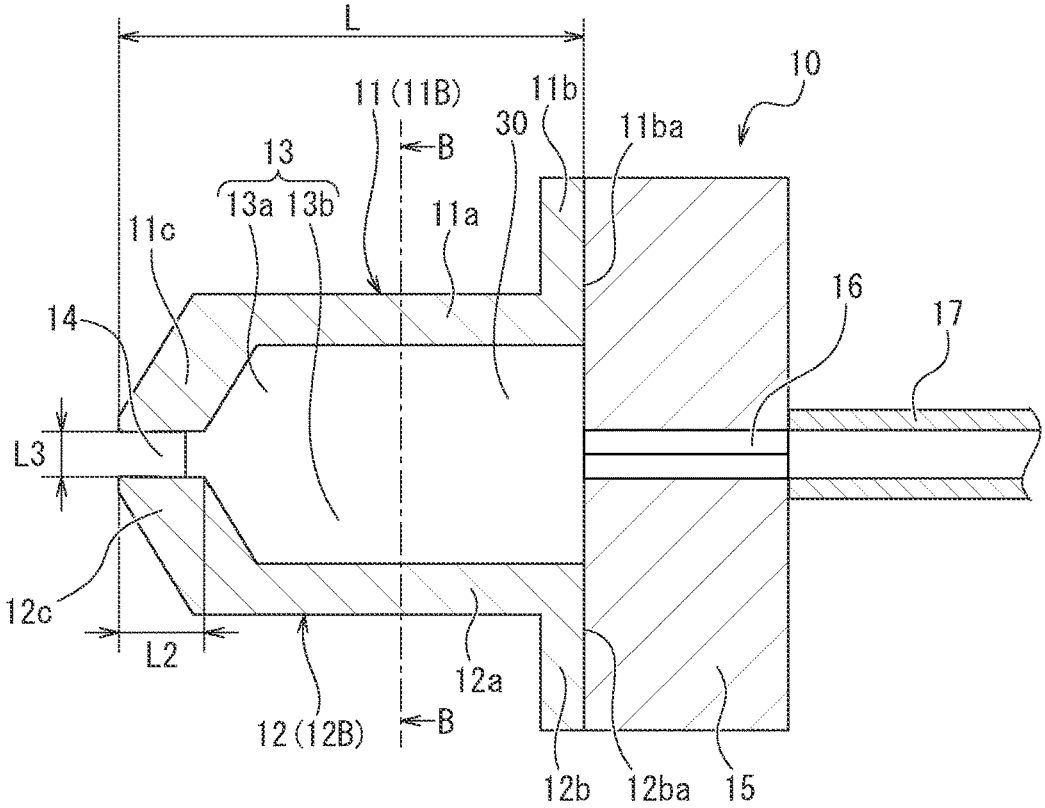
FIG. 3 is a cross-sectional view taken along line A-A in FIG. 2.
Figure 4:
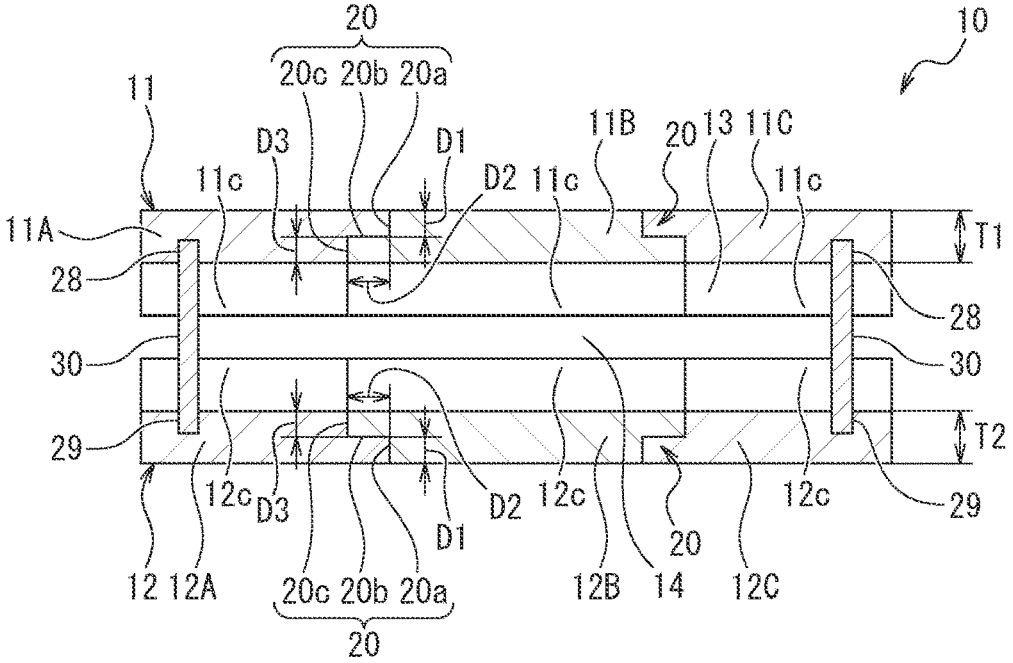
FIG. 4 is a cross-sectional view taken along line B-B in FIG. 3.

The first nozzle member 11 placed at the upper side is divided, as illustrated in FIG. 2, along the length direction X of the slit 14 on a plurality of divided faces 20 into a plurality of (three in the present embodiment) nozzle members 11A, 11B, 11C, as described in detail later. Each nozzle member 11A, 11B, 11C includes, as illustrated in FIG. 2 to FIG. 4, a flat plate portion 11*a* extending in the length direction X and the depth direction (front-to-rear direction) Y and having a certain thickness T1, a flange portion 11*b* protruding upward from the rear end of the flat plate portion 11*a*, and the above-described inclined end portion 11*c* extending obliquely downward from the front end of the flat plate portion 11*a*. Below the flat plate portion 11*a* of each nozzle member 11A, 11B, 11C, a hollow portion-forming space 13*a* forming the hollow portion described later is formed.

The second nozzle member 12 placed at the lower side is also divided, as illustrated in FIG. 2, along the length direction X of the slit 14 on a plurality of divided faces 20 into a plurality of (three in the present embodiment) nozzle members 12A, 12B, 12C. Each nozzle member 12A, 12B, 12C includes, as illustrated in FIG. 2 to FIG. 4, a flat plate portion 12*a* extending in the length direction X and the depth direction (front-to-rear direction) Y and having a certain thickness T2, a flange portion 12*b* protruding downward from the rear end of the flat plate portion 12*a*, and the above-described inclined end portion 12*c* extending obliquely upward from the front end of the flat plate portion 12*a*. Above the flat plate portion 12*a* of each nozzle member 12A, 12B, 12C, a hollow portion-forming space 13*b* forming the hollow portion described later is formed.

The first nozzle member 11 and the second nozzle member 12 are joined vertically and are fixed with the shim members 30 described later, and a rear end face 11*ba* of the flange portion 11*b* of the first nozzle member 11 and a rear end face 12*ba* of the flange portion 12*b* of the second nozzle member 12 are connected to a front face of the nozzle header 15. The hollow portion-forming space 13*a* formed by the first nozzle member 11 and the hollow portion-forming space 13*b* formed by the second nozzle member 12 accordingly form a hollow portion 13.

The bottom face of the inclined end portion 11 *c* at the steel strip S side of the first nozzle member 11 and the top face of the inclined end portion 12*c* at the steel strip S side of the second nozzle member 12 are flat faces facing together, and the above-described slit 14 as a gas blowing port is formed between the flat faces. The slit 14 is thin, extends in the length direction X as described above, and has a length L1 in the length direction X (see FIG. 2), a width or a gap L3 in the width direction Z orthogonal to the length direction X (see FIG. 3), and a depth L2 in the depth direction Y orthogonal to the length direction X (see FIG. 3). The slit 14 may have any dimensions, but the length L1 of the slit 14 is set in consideration of a margin for the width of a steel strip S and may be set, for example, at about 1,500 to 2,500 mm. The gap L3 of the slit 14 may be set, for example, at about 0.5 to 3.0 mm. The depth L2 of the slit 14 may be set, for example, at about 5 to 30 mm.

The slit 14 communicates with the hollow portion 13 in the depth direction Y. The hollow portion 13 functions as a pressure equalizing portion, and a wiping gas introduced from the gas supply pipe 17 through the gas supply path 16 into the hollow portion 13 is blown at a uniform pressure over the length direction X of the slit 14.

Each gas wiping nozzle 10 includes, as illustrated in FIG. 2 to FIG. 4, a pair of shim members 30 that adjust the gap L3 in the width direction Z orthogonal to the length direction X of the slit 14.

These shim members 30 also function to fix the first nozzle member 11 and the second nozzle member 12. To fix the first nozzle member 11 and the second nozzle member 12 with these shim members 30, each of the first nozzle member 11 and the second nozzle member 12, specifically, each of the nozzle members 11A, 11C and the nozzle members 12A, 12C has a groove 28, 29 into which the shim member 30 is fitted as illustrated in FIG. 4.

The first nozzle member 11, the second nozzle member 12, and the shim members 30 are made from a ceramic material, a carbon material, a carbon fiber-reinforced carbon composite material, or a ceramic-based composite material, which has a low wettability to a molten metal such as molten zinc, is unlikely to undergo plastic deformation, and has a low linear expansion coefficient. Specifically, examples of the ceramic material include, but are not limited to, alumina, sialon, silicon nitride, zirconia, barium titanate, hydroxyapatite, silicon carbide (SiC), and fluorite, and examples of the carbon material include, but are not limited to, graphite. Graphite oxidizes and volatilizes in a highly oxidizing atmosphere, and thus the surface layer thereof is preferably coated with silica or the like.

Invar and tungsten have a low linear expansion coefficient but undergo plastic deformation and thus are unsuitable as the materials of the first nozzle member 11, the second nozzle member 12, and the shim members 30, especially as the material of the shim members 30.

The ceramic material, the carbon material, the carbon fiber-reinforced carbon composite material, or the ceramic-based composite material preferably has a flexural strength of 600 MPa or more preferably 800 MPa or more. Hence, the ceramic material is preferably zirconia, silicon nitride, sialon, or the like. By using such a material, the members are unlikely to undergo plastic deformation, and deformation can be substantially suppressed at a disruptive strength or lower.

If zinc adheres to the first nozzle member 11 and the second nozzle member 12 to clog the slit 14 during operation of the apparatus, the zinc adhesion amount partially increases on a part corresponding to the clogged part, and a linear defect is formed on a steel strip S in the same direction as the traveling direction of the steel strip S. The zinc adhering to the first nozzle member 11 and the second nozzle member 12 is thus removed by a special jig. In the removing, a nozzle surface having a low hardness may be cracked or chipped. To prevent such cracking or chipping, the ceramic material, the carbon material, the carbon fiber-reinforced carbon composite material, or the ceramic-based composite material preferably has a Vickers hardness of 800 Hv or more and more preferably 1,000 Hv or more. For a similar reason, the ceramic material, the carbon material, the carbon fiber-reinforced carbon composite material, or the ceramic-based composite material preferably has a fracture toughness of 5 $MPa \cdot m^{1/2}$ or more.

When a high-temperature gas is used as the wiping gas, a nozzle material having a thermal shock resistance of not higher than the temperature of the high-temperature gas may cause cracking. The ceramic material, the carbon material, the carbon fiber-reinforced carbon composite material, or the ceramic-based composite material desirably has a thermal shock resistance of not less than the temperature of a used wiping gas, preferably has a thermal shock resistance of 430° C. or more, and more preferably has a thermal shock resistance of 600° C. or more.

From the viewpoint of suppressing nozzle deformation by heat, the first nozzle member 11 (nozzle members 11A, 11B, 11C) and the second nozzle member 12 (nozzle members 12A, 12B, 12C) preferably has a linear expansion coefficient of not more than ½ of the linear expansion coefficient of the nozzle header 15 fixed to the first nozzle member 11 and the second nozzle member 12 and more preferably not more than ⅓ of that. As the material of the nozzle header 15, for example, stainless steel or the like is used, and the linear expansion coefficient thereof is about 10 to $18 \times 10^{-5}$/K.

When a ceramic material is selected as the material unlikely to undergo plastic deformation, to manufacture the first nozzle member 11 and the second nozzle member 12, a monobloc product having a typical nozzle width of 1,500 mm or more is difficult to manufacture due to, for example, the restriction of the size of a furnace for sintering ceramics. When a carbon material is selected as the material unlikely to undergo plastic deformation, to manufacture the first nozzle member 11 and the second nozzle member 12, similarly, a monobloc product having a typical nozzle width of 1,500 mm or more is difficult to manufacture due to, for example, the restriction of the size of a die used for forming.

When a carbon fiber-reinforced carbon composite material or a ceramic-based composite material is selected to manufacture the first nozzle member 11 and the second nozzle member 12, similarly, a monobloc product having a typical nozzle width of 1,500 mm or more is difficult to manufacture due to the restriction of a furnace for forming. Hence, when a ceramic material, a carbon material, a carbon fiber-reinforced carbon composite material, or a ceramic-based composite material is selected to manufacture the first nozzle member 11 and the second nozzle member 12, as described above, the first nozzle member 11 is divided along the length direction X of the slit 14 on a plurality of divided faces 20 into a plurality of (three in the present embodiment)

nozzle members 11A, 11B, 11C, and the second nozzle member 12 is divided along the length direction X of the slit 14 on a plurality of divided faces 20 into a plurality of (three in the present embodiment) nozzle members 12A, 12B, 12C.

In the present embodiment, as illustrated in FIG. 4, in a section of the first nozzle member 11 that is cut in the length direction X of the slit 14, at at least one point on the depth direction Y orthogonal to the length direction X of the slit 14, the dimension (D1+D2+D3) of the divided face 20 of the first nozzle member 11 is 1.5T1 or more where T1 is the thickness of the first nozzle member 11 in the width direction Z of the slit 14, and in a section of the second nozzle member 12 that is cut in the length direction X of the slit 14, at at least one point on the depth direction Y orthogonal to the length direction X of the slit 14, the dimension (D1+D2+D3) of the divided face 20 of the second nozzle member 12 is 1.5T2 or more where T2 is the thickness of the second nozzle member 12 in the width direction Z of the slit 14.

T1 and T2 may be the same thickness or different thicknesses where T1 is the thickness of the first nozzle member 11 in the width direction Z of the slit 14, and T2 is the thickness of the second nozzle member 12 in the width direction Z of the slit 14.

Figure 5:
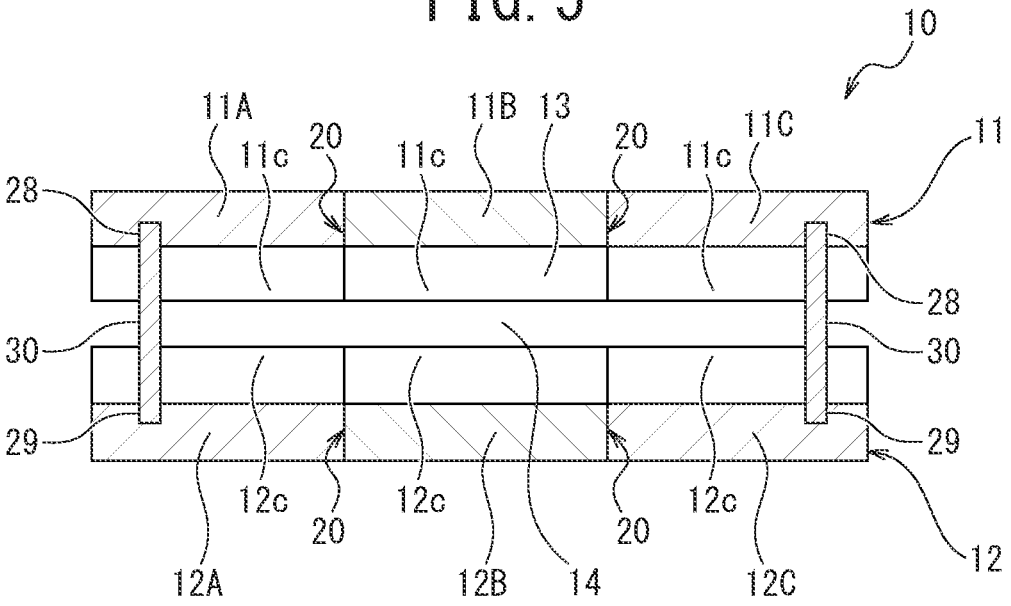
FIG. 5 is a sectional view of a gas wiping nozzle pertaining to a reference example, similar to FIG. 4.

The reason for the dimension of the divided face 20 being 1.5T1 or 1.5T2 or more will next be described. When each of the first nozzle member 11 and the second nozzle member 12 is divided along the length direction X of the slit 14 on a plurality of divided faces 20 into a plurality of nozzle members 11A, 11B, 11C, 12A, 12B, 12C, the divided face 20 can have a linear shape parallel with the nozzle thickness direction (the width direction Z of the slit 14) and have a length equal to each thickness of the first nozzle member 11 and the second nozzle member 12 in the width direction Z of the slit 14, and an adhesive can be applied onto the divided faces 20 for assembly, as illustrated in FIG. 5.

Figure 6:
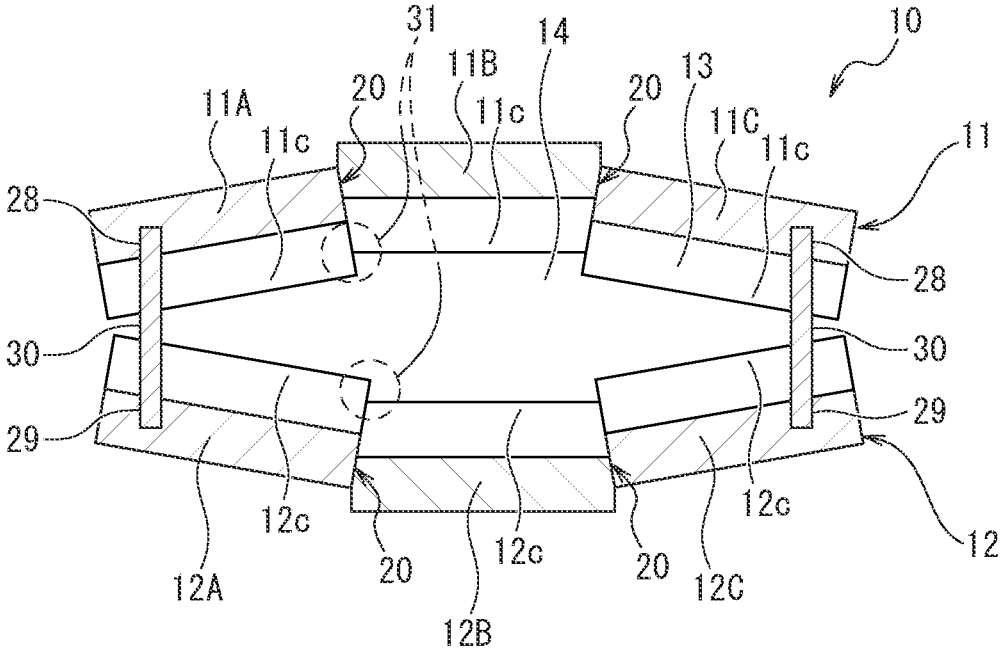
FIG. 6 is a sectional view for describing how divided faces of a first nozzle member and a second nozzle member slip in the gas wiping nozzle pertaining to reference example illustrated in FIG. 5.

In the above method, however, the nozzle members 11B, 12B that are located at the center in the length direction X of the slit 14 and are not fixed vertically by a pair of shim members 30 are easily affected by a force in the width direction (Z direction in FIG. 1) orthogonal to the length direction of the slit 14, and heat deformation by an ejected high-temperature gas causes slippages 31 on the divided faces 20 in directions of expanding the gap of the slit 14 as illustrated in FIG. 6. In addition to this, nozzle cleaning for removing zinc clogged in the slit 14 or the internal pressure of a gas may cause slippages 31 on the divided faces 20. The slippages 31 deform the hollow portion 13 as illustrated in FIG. 6, and the gap of the slit 14 deforms in the nozzle width direction. From a slit 14 having a different gap shape, a gas is ejected in varies amounts in the length direction X of the slit 14 to vary the wiping performance in the length direction X of the slit 14. As a result, the coating amount on a steel strip S cannot be uniformized in the width direction of the steel strip S. As illustrated in FIG. 6, if a slit 14 has a larger gap, zinc splashed by a wiping gas is more likely to enter the slit 14. As a result, the slit 14 clogged with zinc is likely to cause uneven linear adhesion (linear marks).

To solve the problems, the nozzle members 11B, 12B located at the center in the length direction X of the slit 14 are required to be prevented from deforming in the width direction Z of the slit 14, or the fastening force between the nozzle members 11A, 11B, 11C, 12A, 12B, 12C is required to be increased. In the present embodiment, as illustrated in FIG. 4, in a section of the first nozzle member 11 that is cut in the length direction X of the slit 14, at at least one point on the depth direction Y, the dimension (D1+D2+D3) of each divided face 20 of the first nozzle member 11 is 1.5T1 or more where T1 is the thickness of the first nozzle member 11 (the thickness of the flat plate portion 11*a*) in the width direction Z of the slit 14, and in a section of the second nozzle member 12 that is cut in the length direction X of the slit 14, at at least one point on the depth direction Y, the dimension (D1+D2+D3) of each divided face 20 of the second nozzle member 12 is 1.5T2 or more where T2 is the thickness of the second nozzle member 12 (thickness of the flat plate portion 12*a*) in the width direction Z of the slit 14.

In FIG. 4, each divided face 20 of the first nozzle member 11 and the second nozzle member 12 has a step 20*b*. In other words, each divided face 20 of the first nozzle member 11 includes a first linear portion 20*a* linearly extending downward from the top face of the first nozzle member 11 (flat plate portion 11*a*), a step 20*b* linearly extending outward from the lower end of the first linear portion 20*a* in the length direction X of the slit 14, and a second linear portion 20*c* linearly extending downward from an end of the step 20*b* to the bottom face of the first nozzle member 11 (flat plate portion 11*a*). Each divided face 20 of the second nozzle member 12 includes a first linear portion 20*a* linearly extending upward from the bottom face of the second nozzle member 12 (flat plate portion 12*a*), a step 20*b* linearly extending outward from the upper end of the first linear portion 20*a* in the length direction X of the slit 14, and a second linear portion 20*c* linearly extending upward from an end of the step 20*b* to the top face of the second nozzle member 12 (flat plate portion 12*a*).

The total dimension (D1+D2+D3) of the dimension D1 of the first linear portion 20*a*, the dimension D2 of the step 20*b*, and the dimension D3 of the second linear portion 20*c* of each divided face 20 is 1.5T1 or more for the first nozzle member 11 and is 1.5T2 or more for the second nozzle member 12.

If the dimension (D1+D2+D3) of each divided face 20 is less than 1.5T1 or 1.5T2, the divided face 20 has a similar shape to that illustrated in FIG. 5, and the nozzle members 11B, 12B located at the center in the length direction X of the slit 14 easily move in the width direction Z of the slit 14. The effect by the shape including the step 20*b* is thus unlikely to be exerted.

If the dimension (D1+D2+D3) of each divided face 20 is more than 5T1 or 5T2, the effect of improving the fastening force between the nozzle members 11A, 11B, 11C, 12A, 12B, 12C reaches the limit, and a divided face 20 having an excessively large dimension may crack. Hence, the upper limit of the dimension of the divided face 20 of the first nozzle member 11 is preferably 5T1, and the upper limit of the dimension of the divided face 20 of the second nozzle member 12 is preferably 5T2.

Figure 7:
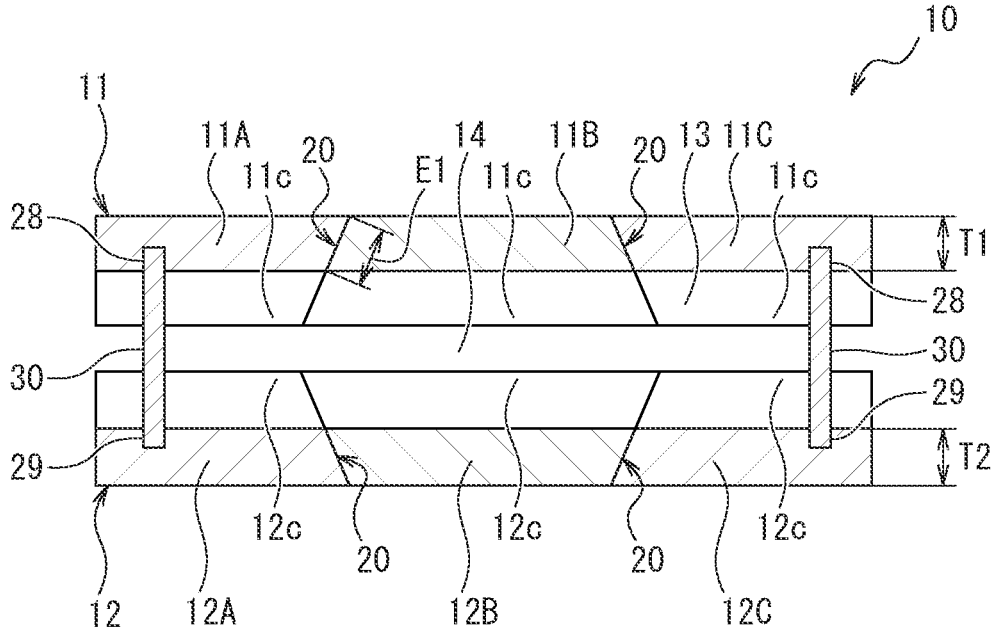
FIG. 7 is a sectional view of a gas wiping nozzle pertaining to a first alternative embodiment, similar to FIG. 4.

To make each divided face 20 have a dimension of 1.5T1 or more or 1.5T2 or more, each divided face 20 of the first nozzle member 11 and the second nozzle member 12 may have a taper shape that inclines with respect to the width direction Z of the slit 14 (vertical direction) as a gas wiping nozzle 10 pertaining to a first alternative embodiment and illustrated in FIG. 7. In this case, each divided face 20 is inclined such that the dimension E1 of the divided face 20 is 1.5T1 or more for the first nozzle member 11 and is 1.5T2 or more for the second nozzle member 12. Even in this case, the upper limit of the dimension E1 of each divided face 20 is preferably 5T1 or 5T2.

In the cases illustrated in FIG. 4 and FIG. 7, typically, the gap of a slit 14 tends to expand due to the internal pressure of a gas or heat effect, and thus the nozzle division is designed under the concept of suppressing the gap expansion of the slit 14.

In contrast, a gap shrinkage of the slit 14 may become problematic. In such a case, a divided face 20 having such a shape as illustrated in FIG. 8 or FIG. 9 suppresses the gap shrinkage of the slit 14.

Figure 8:
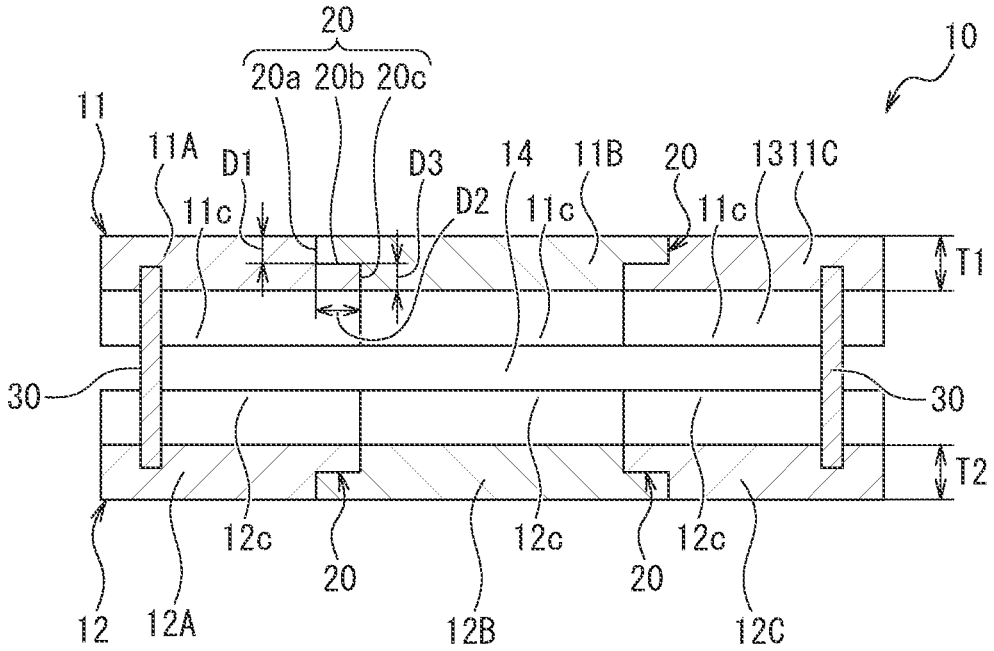
FIG. 8 is a sectional view of a gas wiping nozzle pertaining to a second alternative embodiment, similar to FIG. 4.

FIG. 8 illustrates a section of a gas wiping nozzle pertaining to a second alternative embodiment, and each divided face 20 of a first nozzle member 11 and a second nozzle member 12 has a symmetrical shape to the shape of each divided face 20 illustrated in FIG. 4. In other words, each divided face 20 of the first nozzle member 11 includes a first linear portion 20*a* linearly extending downward from the top face of the first nozzle member 11 (flat plate portion 11*a*), a step 20*b* linearly extending inward from the lower end of the first linear portion 20*a* in the length direction X of the slit 14, and a second linear portion 20*c* linearly extending downward from an end of the step 20*b* to the bottom face of the first nozzle member 11 (flat plate portion 11*a*). Each divided face 20 of the second nozzle member 12 also includes a first linear portion 20*a* linearly extending upward from the bottom face of the second nozzle member 12 (flat plate portion 11*a*), a step 20*b* linearly extending inward from the upper end of the first linear portion 20*a* in the length direction X of the slit 14, and a second linear portion 20*c* linearly extending upward from an end of the step 20*b* to the top face of the second nozzle member 12 (flat plate portion 12*a*), where signs are not illustrated in FIG. 8.

The total dimension (D1+D2+D3) of the dimension D1 of the first linear portion 20*a*, the dimension D2 of the step 20*b*, and the dimension D3 of the second linear portion 20*c* of each divided face 20 is 1.5T1 or more for the first nozzle member 11 and is 1.5T2 or more for the second nozzle member 12.

Figure 9:
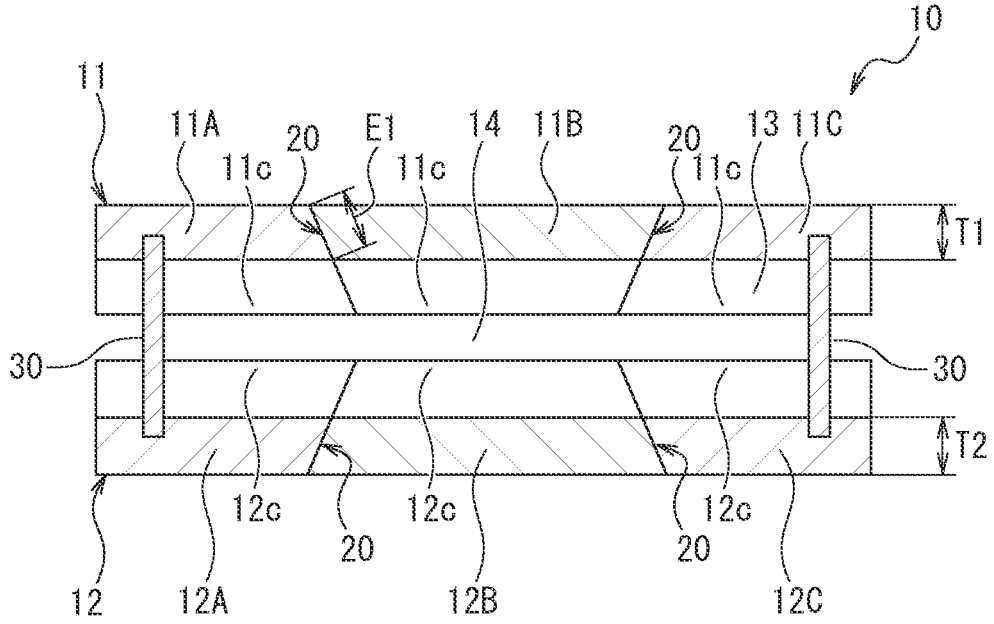
FIG. 9 is a sectional view of a gas wiping nozzle pertaining to a third alternative embodiment, similar to FIG. 4.

FIG. 9 illustrates a section of a gas wiping nozzle pertaining to a third alternative embodiment, and each divided face 20 of a first nozzle member 11 and a second nozzle member 12 has a symmetrical shape to the shape of each divided face 20 of the first nozzle member 11 and the second nozzle member 12 of the gas wiping nozzle 10 pertaining to the first alternative embodiment and illustrated in FIG. 7.

Figure 10:
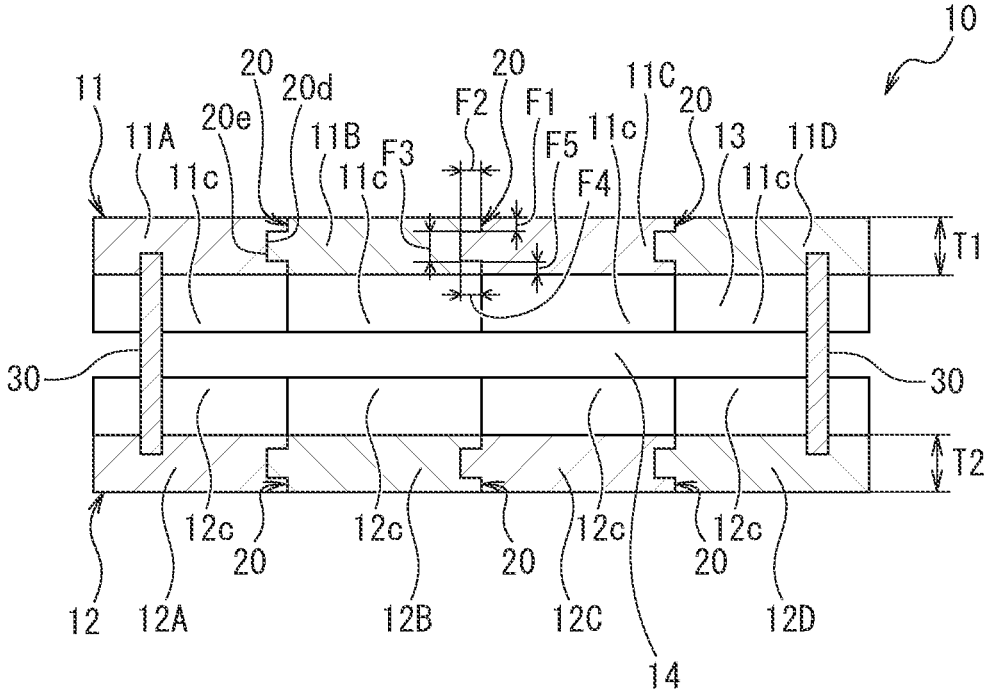
FIG. 10 is a sectional view of a gas wiping nozzle pertaining to a fourth alternative embodiment, similar to FIG. 4.

When each of the first nozzle member 11 and the second nozzle member 12 is divided along the length direction X of the slit 14 on a plurality of divided faces 20 into a plurality of nozzle members, unlike the case illustrated in FIG. 4 (each member is divided into three members), each member may be divided into four nozzle members 11A, 11B, 11C, 11D, 12A, 12B, 12C, 12D, as a gas wiping nozzle pertaining to a fourth alternative embodiment and illustrated in FIG. 10.

To make each divided face 20 have a dimension of 1.5T1 or more or 1.5T2 or more, each divided face 20 of the first nozzle member 11 and the second nozzle member 12 may have such a fitting face shape that a concave face 20*d* and a convex face 20*e* of the adjacent divided nozzle members 11A and 11B, 11B and 11C, 11C and 11D, 12A and 12B, 12B and 12C, 12C and 12D fit together, as the gas wiping nozzle pertaining to the fourth alternative embodiment and illustrated in FIG. 10. The adjacent divided nozzle members 11A and 11B will be described as an example. The divided face 20 has such a key shape that the concave face 20*d* formed on the nozzle member 11A fits the convex face 20*e* formed on the nozzle member 11B.

In the gas wiping nozzle 10 pertaining to the fourth alternative embodiment and illustrated in FIG. 10, the divided faces 20 have substantially the same dimension, and thus the dimension of the divided face 20 formed in the first nozzle member 11 will be described. The dimension of the divided face 20 is the sum of the dimension F1 of a first linear portion linearly extending downward from the top face of the first nozzle member 11 (flat plate portion 11*a*), the dimension F2 of a second linear portion linearly extending outward from the lower end of the first linear portion in the length direction X of the slit 14, the dimension F3 of a third linear portion linearly extending downward from an end of the second linear portion, the dimension F4 of a fourth linear portion linearly extending inward from the lower end of the third linear portion in the length direction X of the slit 14, and the dimension F5 of a fifth linear portion linearly extending downward from an end of the fourth linear portion to the bottom face of the first nozzle member 11 (flat plate portion 11*a*).

By making each divided face 20 of the first nozzle member 11 and the second nozzle member 12 have such a fitting face shape, the fastening force between the nozzle members 11A, 11B, 11C, 11D, 12A, 12B, 12C, 12D is increased, and even if an external force is applied to the divided faces 20 to expand or shrink the gap of the slit 14, the gap expansion or shrinkage is appropriately suppressed.

To make each divided face 20 have a fitting face shape, the fitting face shape may be a dogleg shape.

Figure 11:
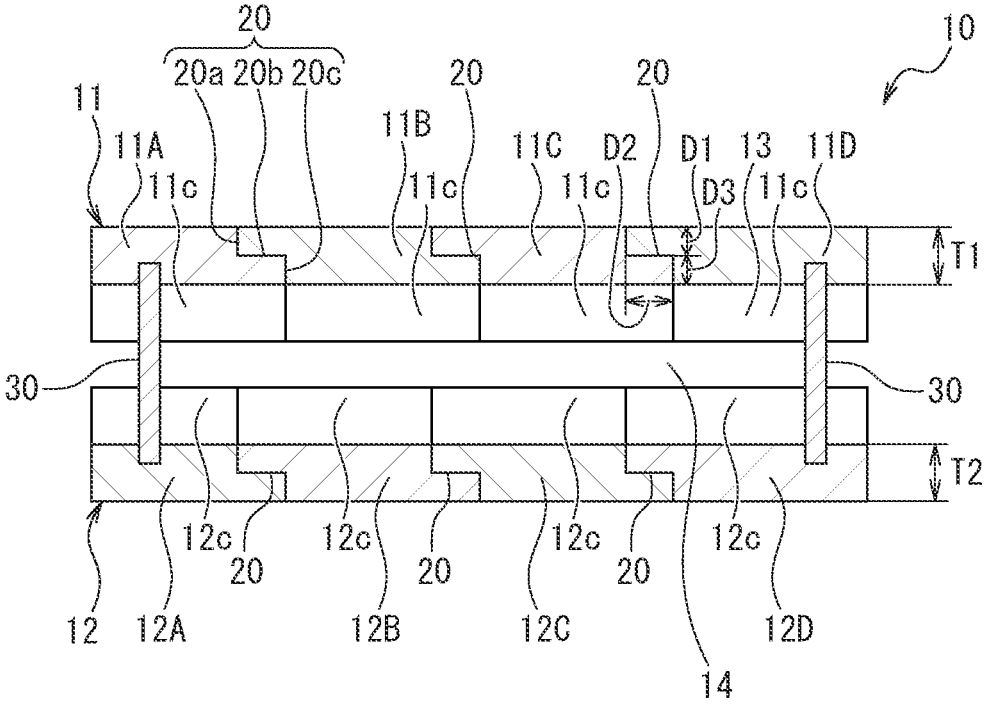
FIG. 11 is a sectional view of a gas wiping nozzle pertaining to a fifth alternative embodiment, similar to FIG. 4.

To make each divided face 20 have a dimension of 1.5T1 or more or 1.5T2 or more, each divided face 20 of the first nozzle member 11 and the second nozzle member 12 may have such a shape that the adjacent divided nozzle members 11A and 11B, 11B and 11C, 11C and 11D, 12A and 12B, 12B and 12C, 12C and 12D are engaged, as a gas wiping nozzle pertaining to a fifth alternative embodiment and illustrated in FIG. 11.

In the gas wiping nozzle 10 pertaining to the fifth alternative embodiment and illustrated in FIG. 11, the dimension of each divided face 20 is the total dimension (D1+D2+D3) of the dimension D1 of a first linear portion 20*a*, the dimension D2 of a step 20*b*, and the dimension D3 of a second linear portion 20*c* as with the gas wiping nozzle 10 illustrated in FIG. 4, is 1.5T1 or more for the first nozzle member 11, and is 1.5T2 or more for the second nozzle member 12. The gas wiping nozzle 10 pertaining to the fifth alternative embodiment and illustrated in FIG. 11 is an example in which a nozzle is divided into four members. For example, when divided into five members, the nozzle may have such a structure as a gas wiping nozzle 10 pertaining to a sixth alternative embodiment and illustrated in FIG. 12.

Figure 13:
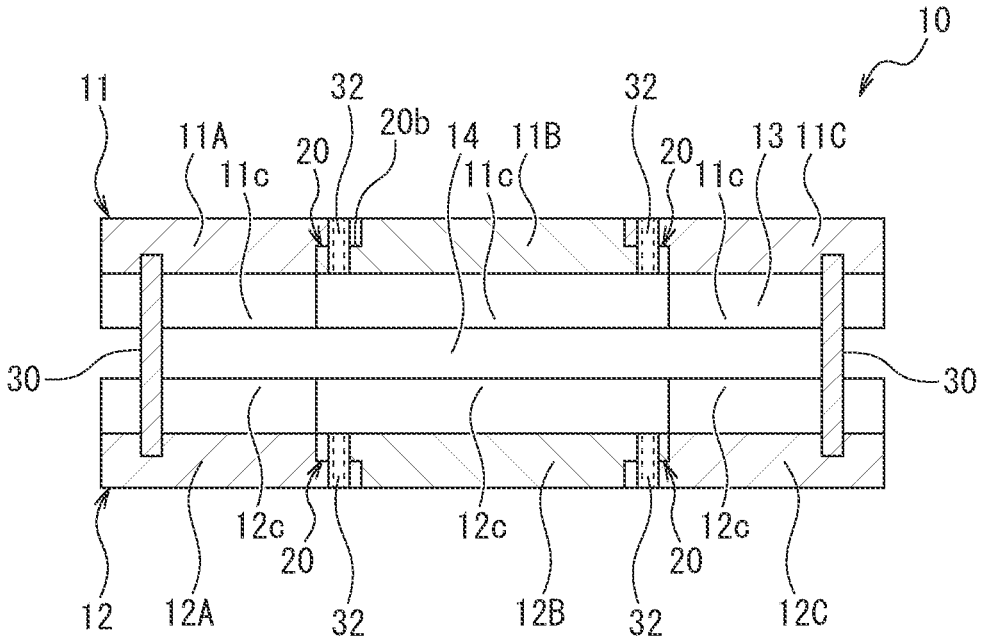
FIG. 13 is a sectional view of a gas wiping nozzle pertaining to a seventh alternative embodiment, similar to FIG. 4.
Figure 14:
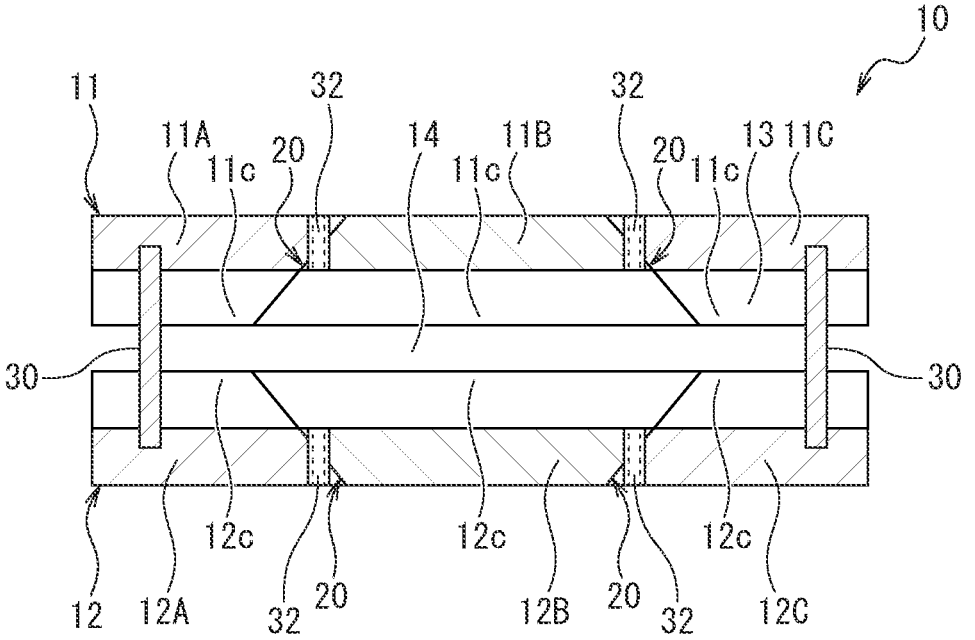
FIG. 14 is a sectional view of a gas wiping nozzle pertaining to an eighth alternative embodiment, similar to FIG. 4.

To increase the fastening force between nozzle members 11A, 11B, 11C, 12A, 12B, 12C, pins 32 may be used to connect the divided nozzle members 11A and 11B, 11B and 11C of the first nozzle member 11 and the divided nozzle members 12A and 12B, 12B and 12C of the second nozzle member 12 as in a gas wiping nozzle pertaining to a seventh alternative embodiment and illustrated in FIG. 13 or in a gas wiping nozzle pertaining to an eighth alternative embodiment and illustrated in FIG. 14. This increases the fastening force between the divided nozzle members 11A and 11B, 11B and 11C, 12A and 12B, 12B and 12C.

The pin 32 may have a rectangular cross-sectional shape or a circular cross-sectional shape. In the gas wiping nozzle pertaining to the seventh alternative embodiment and illustrated in FIG. 13, when the pin 32 is inserted into the step 20*b* of the divided face 20 in the width direction Z of the slit 14, the dimension of the pin 32 in the slit length direction X should be less than the dimension D2 of the step 20*b*.

In the gas wiping nozzle pertaining to the eighth alternative embodiment and illustrated in FIG. 14, when the pin 32 is inserted into the taper-shaped divided face 20 in the width direction Z of the slit 14, the dimension of the pin 32 in the slit length direction X should be less than the dimension between one end of the taper-shaped divided face 20 and the other end.

Figure 15:
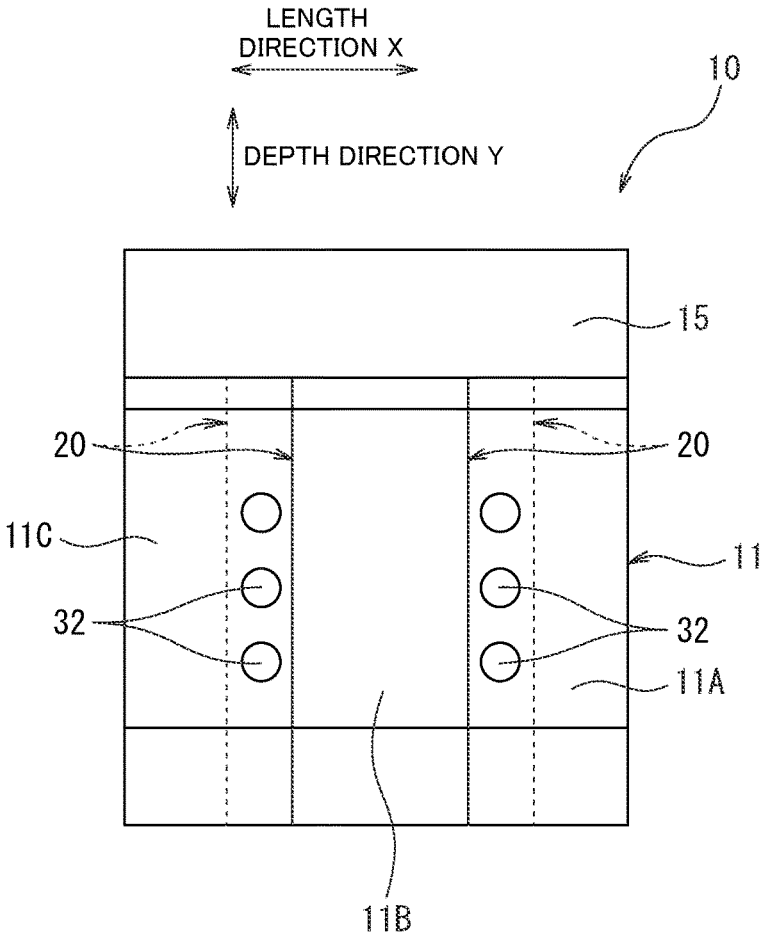
FIG. 15 is a schematic plan view of the gas wiping nozzle pertaining to the seventh alternative embodiment illustrated in FIG. 13.

In the gas wiping nozzle pertaining to the seventh alternative embodiment and illustrated in FIG. 13 and the gas wiping nozzle pertaining to the eighth alternative embodiment and illustrated in FIG. 14, when pins 32 are inserted as illustrated in FIG. 15, any number of the pins 32 may be inserted in the slit length direction X and the slit depth direction Y at any positions.

A method of fixing the first nozzle member 11 and the second nozzle member 12 will next be described with reference to FIG. 1 to FIG. 4.

The first nozzle member 11 and the second nozzle member 12 are first assembled. Before assembling the first nozzle member 11 and the second nozzle member 12, the nozzle member 11A and the nozzle member 11C of the first nozzle member 11 are grooved from the rear end face 11*ba* to form grooves 28, and the nozzle member 12A and the nozzle member 12C of the second nozzle member 12 are grooved from the rear end face 12*ba* to form grooves 29.

To assemble the first nozzle member 11, the adjacent nozzle members 11A, 11B are fitted on the divided face 20, and an adhesive for ceramics is applied to fix the adjacent nozzle members 11A, 11B. The adjacent nozzle members 11B, 11C are fitted on the divided face 20, and an adhesive for ceramics is applied to fix the adjacent nozzle members 11B, 11C. Accordingly, the assembling the first nozzle member 11 is completed.

To assemble the second nozzle member 12, the adjacent nozzle members 12A, 12B are fitted on the divided face 20, and an adhesive for ceramics is applied to fix the adjacent nozzle members 12A, 12B. The adjacent nozzle members 12B, 12C are fitted on the divided face 20, and an adhesive for ceramics is applied to fix the adjacent nozzle members 12B, 12C. Accordingly, the assembling the second nozzle member 12 is completed. Examples of the adhesive used to assemble the first nozzle member 11 and the second nozzle member 12 include, but are not limited to, an adhesive mainly containing zirconia and silica, an adhesive mainly containing alumina, and an adhesive mainly containing silica.

The assembled first nozzle member 11 is placed at the upper side, and the assembled second nozzle member 12 is placed at the lower side. To the grooves 28 of the first nozzle member 11 and to the grooves 29 of the second nozzle member 12, shim members 30 are fitted from the end faces 11*ba*, 12*ba* of the first nozzle member 11 and the second nozzle member 12 in a direction parallel with the extending direction of the grooves 28, 29. For the fitting, a similar adhesive to the above is applied to the grooves 28 of the first nozzle member 11 and the grooves 29 of the second nozzle member 12.

Accordingly, the first nozzle member 11 and the second nozzle member 12 are fixed.

The rear end face 11*ba* of the fixed first nozzle member 11 and the rear end face 12*ba* of the second nozzle member 12 may then be connected to the front-end face of the nozzle header 15 with fixing members such as screws (not illustrated).

When the gas wiping nozzle 10 pertaining to the present embodiment is placed in a high temperature atmosphere, and a high-temperature gas is ejected from the slit 14, heat deformation during the ejection would cause slippages on the divided faces 20 in directions of expanding the gap L3 of the slit 14. In the present embodiment, as illustrated in FIG. 4, in a section of the first nozzle member 11 that is cut in the length direction X of the slit 14, the dimension (D1+D2+D3) of each divided face 20 of the first nozzle member 11 is 1.5T1 or more where T1 is the thickness of the first nozzle member 11 (the thickness of the flat plate portion 11*a*) in the width direction Z of the slit 14, and in a section of the second nozzle member 12 that is cut in the length direction X of the slit 14, the dimension (D1+D2+D3) of each divided face 20 of the second nozzle member 12 is 1.5T2 or more where T2 is the thickness of the second nozzle member 12 (thickness of the flat plate portion 12*a*) in the width direction Z of the slit 14. Hence, the nozzle members 11B, 12B located at the center in the length direction X of the slit 14 are prevented from deforming in the width direction Z of the slit 14, or the fastening force between the nozzle members 11A, 11B, 11C, 12A, 12B, 12C is increased. Accordingly, the divided faces 20 do not slip in directions of expanding the gap L3 of the slit 14 due to heat deformation, and the gap L3 in the width direction Z orthogonal to the length direction X of the slit 14 is maintained to be constant over the length direction X of the slit 14. Accordingly, the gas ejection amount is constant in the length direction X of the slit 14, and the wiping performance does not fluctuate in the length direction X of the slit 14. As a result, the coating amount on a steel strip S is uniformized in the width direction of the steel strip S.

In the gas wiping nozzle 10 pertaining to the present embodiment, the upper limit of the dimension (D1+D2+D3) of the divided face 20 of the first nozzle member 11 is 5T1, and the upper limit of the dimension (D1+D2+D3) of the divided face 20 of the second nozzle member 12 is 5T2. This prevents the nozzle members 11A, 11B, 11C, 12A, 12B, 12C included in the first nozzle member 11 and the second nozzle member 12 from cracking.

In FIG. 2, when each of the first nozzle member 11 and the second nozzle member 12 has a divided face 20 having a dimension of 1.5T1 or more or 1.5T2 or more in a section of the members cut at at least one point in the depth direction Y, the slit 14 maintains a constant gap. Under the condition, however, the first nozzle member 11 (the nozzle members 11A, 11B, 11C) and the second nozzle member 12 (the nozzle members 12A, 12B, 12C) may crack. To suppress the cracking, the region in the depth direction Y where the dimension of each divided face 20 of the first nozzle member 11 and the second nozzle member 12 is 1.5T1 or more for the first nozzle member 11 and 1.5T2 or more for the second nozzle member 12 is preferably a region having a dimension of not less than ⅓ of the full dimension L (see FIG. 3) in the depth direction of each of the first nozzle member 11 and the second nozzle member 12 and is more preferably a region having the same dimension as the full dimension L.

In the gas wiping nozzle 10 pertaining to the present embodiment, all the first nozzle member 11, the second nozzle member 12, and the shim members 30 are made from a ceramic material, a carbon material, a carbon fiber-reinforced carbon composite material, or a ceramic-based composite material, which has a small linear expansion coefficient, and the members have no difference in linear expansion coefficient. Accordingly, the gap L3 in the width direction orthogonal to the length direction X of the slit 14 as a gas blowing port is maintained to be constant over the length direction X of the slit even in a high temperature atmosphere.

Although using a nozzle header 15 also made from a ceramic material, a carbon material, a carbon fiber-reinforced carbon composite material, or a ceramic-based composite material is further effective in maintaining the gap L3 of the slit 14 to be constant, it is difficult to prepare a ceramic material, a carbon material, a carbon fiber-reinforced carbon composite material, or a ceramic-based composite material capable of withstanding a high-pressure wiping gas (capable of withstanding at least 60 kPa), and thus the nozzle header 15 is not made from a ceramic material, a carbon material, a carbon fiber-reinforced carbon composite material, or a ceramic-based composite material.

In the gas wiping nozzle disclosed in PTL 3, a first lip part and a second lip part are fixed with a fixing member at the slit side in a nozzle chamber, and thus the slit gap can be prevented from varying after each assembly when some or all parts included in the gas wiping nozzle are exchanged.

In the gas wiping nozzle disclosed in PTL 3, however, the fixing member to fix the upper and lower nozzle members, bolts used to fix the fixing members, and the like are made from a metal, and thus the fixing members, the bolts, and the like lengthen in a high temperature atmosphere. This changes the slit gap, and the slit gap cannot be maintained to be constant in the slit length direction.

In contrast, in the gas wiping nozzle 10 pertaining to the present embodiment, not only the first nozzle member 11 and the second nozzle member 12 are made from a ceramic material, a carbon material, a carbon fiber-reinforced carbon composite material, or a ceramic-based composite material, but also the shim members 30 are made from a ceramic material, a carbon material, a carbon fiber-reinforced carbon composite material, or a ceramic-based composite material. In addition, the shim members 30 function to fix the first nozzle member 11 and the second nozzle member 12. This eliminates members that fix the first nozzle member 11 and the second nozzle member 12 but function to expand the gap L3 of the slit 14 in a high temperature atmosphere. The shim members 30 are made from a material unlikely to undergo plastic deformation and thus maintain the constant gap L3 of the slit 14 as a gas blowing port in the length direction X of the slit 14 even in a high temperature atmosphere.

If shim members 30 have no function to fix the first nozzle member 11 and the second nozzle member 12, and the first nozzle member 11 and the second nozzle member 12 made from a ceramic material are fixed with metal bolts, the first nozzle member 11 and the second nozzle member 12 made from a ceramic material needs bolt holes, and metal bolts should be inserted into the bolt holes. In this case, torque during fastening the metal bolts or thermal expansion may damage the first nozzle member 11 and the second nozzle member 12 made from a ceramic material.

In contrast, in the gas wiping nozzle 10 pertaining to the present embodiment, not only the first nozzle member 11 and the second nozzle member 12 are made from a ceramic material, a carbon material, a carbon fiber-reinforced carbon composite material, or a ceramic-based composite material, but also the shim members 30 are made from a ceramic material, a carbon material, a carbon fiber-reinforced carbon composite material, or a ceramic-based composite material. In addition, the shim members 30 function to fix the first nozzle member 11 and the second nozzle member 12. Hence, the first nozzle member 11 and the second nozzle member 12 are not damaged by torque during fastening metal bolts or thermal expansion.

A gas wiping nozzle pertaining to a ninth alternative embodiment will next be described with reference to FIG. 16 and FIG. 17.

Figure 16:
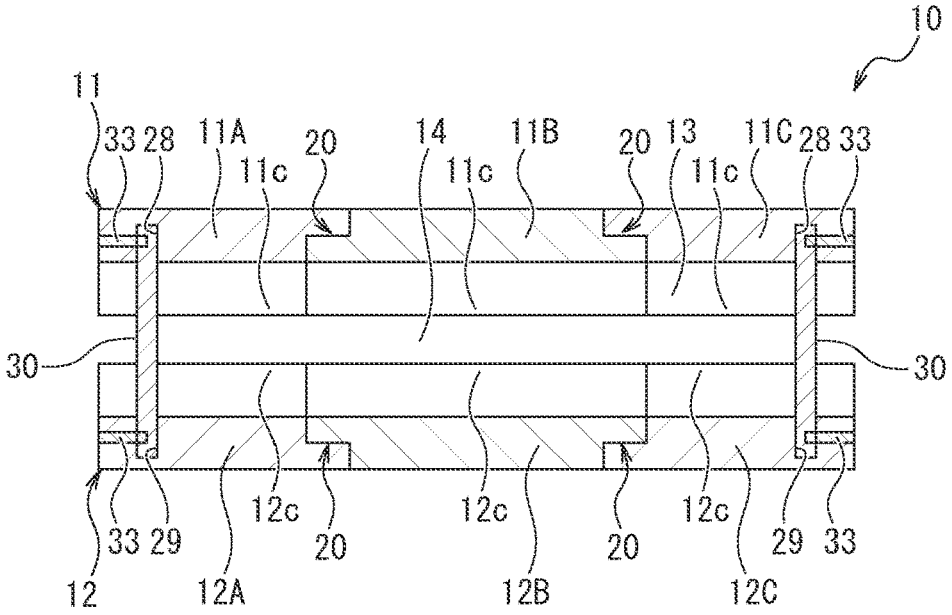
FIG. 16 is a sectional view of a gas wiping nozzle pertaining to a ninth alternative embodiment, similar to FIG. 4.
Figure 17:
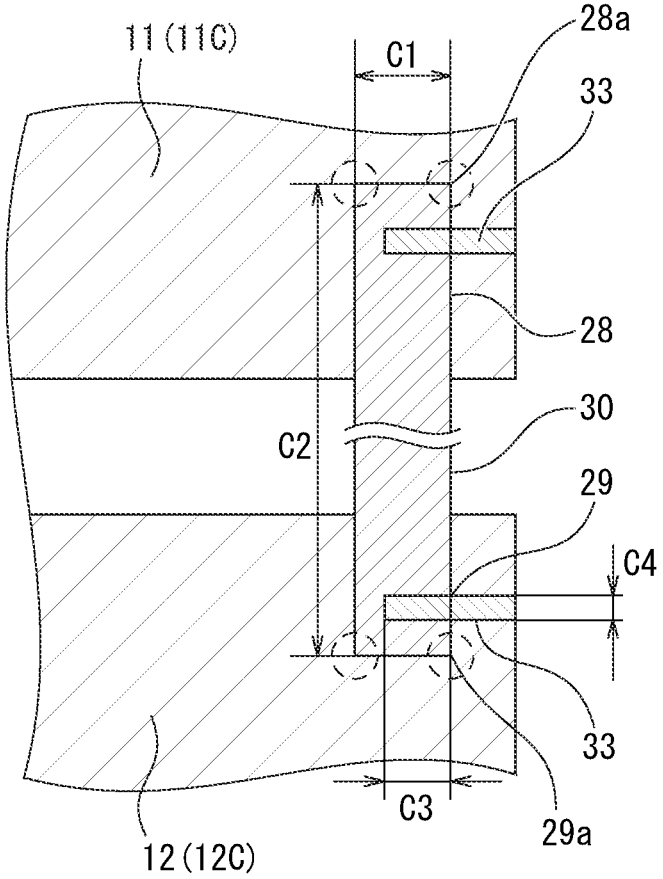
FIG. 17 is an enlarged view of FIG. 16 including a groove of a first nozzle member, a groove of a second nozzle member, a shim member, and pins.

The gas wiping nozzle 10 illustrated in FIG. 16 and FIG. 17 has substantially the same basic configuration as the gas wiping nozzle 10 illustrated in FIG. 4, but differs from the gas wiping nozzle 10 illustrated in FIG. 4 in that pins 33 are used to connect the grooves 28 of the first nozzle member 11 to the shim members 30, and pins 33 are used to connect the grooves 29 of the second nozzle member 12 to the shim members 30.

Each section of the grooves 28 of the first nozzle member 11 and the grooves 29 of the second nozzle member 12 illustrated in FIG. 16 and FIG. 17 has a rectangular shape. The grooves 28 of the first nozzle member 11 extend forward from the rear end face 11*ba* (see FIG. 3). The grooves 29 of the second nozzle member 12 extend forward from the rear end face 12*ba* (see FIG. 3). Corners 28*a* in the grooves 28 and corners 29*a* in the grooves 29 may have a curved shape. This suppresses stress concentration to prevent breakage of the shim member 30.

The shim member 30 has a rectangular parallelepiped shape and has a sectional shape allowing the shim member to be fitted into the groove 28 of the first nozzle member 11 or the groove 29 of the second nozzle member 12. As illustrated in FIG. 17, the shim member 30 has a width C1 of about 5 to 20 mm corresponding to the width of the groove 28, 29, and the shim member 30 has a height C2 of about 5 to 40 mm.

To fix the first nozzle member 11 and the second nozzle member 12, the shim members 30 are fitted into the grooves 28 of the first nozzle member 11 and the grooves 29 of the second nozzle member 12. A plurality of pins 33 are used to connect the grooves 28 of the first nozzle member 11 to the shim members 30 and to connect the grooves 29 of the second nozzle member 12 to the shim members 30. As described above, in the seventh alternative embodiment, the shim members 30 can be fitted before the first nozzle member 11 and the second nozzle member 12 are combined, and this enables assembly without inserting shim members 30 from the rear end faces 11*ba*, 12*ba* of the first nozzle member 11 and the second nozzle member 12 into the grooves 28, 29. Hence, shim members 30 may be provided at a plurality of points in depth direction Y of the first nozzle member 11 and the second nozzle member 12, and this enables highly accurate holding of the gap L3 of the slit 14.

As for pins 33, in the present embodiment, a total of four pins 33 are used: two pins are used to connect the grooves 28 of the first nozzle member 11 to the shim members 30; and two pins are used to connect the grooves 29 of the second nozzle member 12 to the shim members 30, as illustrated in FIG. 16. To provide shim members 30 at a plurality of points in the depth direction Y of the first nozzle member 11 and the second nozzle member 12, the number of pins may be increased according to the number of shim members 30.

To connect the groove 28 of the first nozzle member 11 to the shim member 30, the shim member 30 is fitted into the grooves 28, 29, and then a pin 33 is inserted from the side face of the first nozzle member 11 into the shim member 30 to a predetermined depth C3, as illustrated in FIG. 16 and FIG. 17. Similarly, to connect the groove 29 of the second nozzle member 12 to the shim member 30, the shim member 30 is fitted into the grooves 28, 29, and then a pin 33 is inserted from the side face of the second nozzle member 12 into the shim member 30 to a predetermined depth C3, as illustrated in FIG. 16 and FIG. 17.

In the present embodiment, each pin 33 is formed in a circular cylinder having a diameter C4 of about Φ 1 to 10 mm, and the insertion depth C3 of the pin 33 is about 1 to 15 mm, provided that the insertion depth C3 of the pin 33<the width C1 of the shim member 30, and the diameter C4 of the pin 33<the height C2 of the shim member 30. Each pin 33 is also preferably made from a ceramic material, a carbon material, a carbon fiber-reinforced carbon composite material, or a ceramic-based composite material. Each pin 33 preferably has a flexural strength of 600 MPa or more and more preferably 800 MPa or more. Hence, the ceramic material is preferably zirconia, silicon nitride, sialon, or the like.

When the gas wiping nozzle 10 illustrated in FIG. 16 and FIG. 17 is placed in a high temperature atmosphere, for example, when a wiping gas is heated, and accordingly the gas wiping nozzle 10 itself is heated, the nozzle header 15 made from a metal (see FIG. 1 and FIG. 2) would expand in the vertical direction or in the width direction Z of the slit 14 due to thermal expansion. Accordingly, the first nozzle member 11 and the second nozzle member 12 would move vertically apart due to the expansion. The first nozzle member 11 and the second nozzle member 12 are, however, connected to the shim members 30 with the pins 33, and the shim members 30 are unlikely to undergo plastic deformation. Hence, the first nozzle member 11 and the second nozzle member 12 do not move vertically apart. The first nozzle member 11 and the second nozzle member 12 do not move vertically apart, and thus the gap L3 of the slit 14 formed between the inclined end portions 11*c*, 12*c* at the steel strip S side of the first nozzle member 11 and the second nozzle member 12 is maintained.

Next, in the manufacturing of the steel strip S, it is preferable to control the temperature of the wiping gas so that the temperature T (° C.) of the wiping gas immediately after being blown from the slit 14 of the gas wiping nozzle 10 satisfies $T_M-150 \leq T \leq T_M+250$ in relation to the melting point $T_M$ (° C.) of the molten metal. When the temperature T (° C.) of the wiping gas is controlled in this range, cooling and solidification of the molten metal can be suppressed, so that uneven viscosity is unlikely to occur and the occurrence of hot metal wrinkles can be suppressed. On the other hand, when the temperature T (° C.) of the wiping gas is less than $T_M-150$° C. and is too low, the temperature T does not affect the fluidity of the molten metal and is not effective in suppressing the occurrence of hot metal wrinkles. In addition, when the temperature T (° C.) of the wiping gas is higher than $T_M+250$° C., alloying is promoted and the appearance of the steel sheet is deteriorated.

In addition, a method for raising the temperature of the wiping gas supplied to the gas wiping nozzle 10 is not particularly limited. Examples thereof include a method for heating with a heat exchanger and raising the temperature to supply, and a method for mixing the combustion exhaust gas of the annealing furnace with air.

In addition, examples of the hot-dip metal coated metal strip manufactured by applying the gas wiping nozzle and the method for manufacturing the hot-dip metal coated metal strip according to the present embodiment include a hot-dip galvanized steel strip. The hot-dip galvanized steel strip includes both a coated steel sheet (GI) that is not subjected to an alloying treatment after the hot-dip galvanized treatment and a coated steel sheet (GA) that is subjected to the alloying treatment. However, the hot-dip metal coated metal strip manufactured by applying the gas wiping nozzle and the method for manufacturing the hot-dip metal coated metal strip according to the present embodiment is not limited thereto, and includes all hot-dip metal coated steel strips containing other molten metals such as aluminum and tin other than zinc.

The embodiments of the present invention have been described, but the present invention is not limited to them, and various modifications and improvements can be made.

For example, the number of divided members of each of the first nozzle member 11 and the second nozzle member 12 is three or four in the above description but may be two or five or more.

In a section of the first nozzle member 11 that is cut in the length direction X of the slit 14, the dimension of each divided face 20 of the first nozzle member 11 is at least 1.5T1 or more where T1 is the thickness of the first nozzle member 11 in the width direction Z of the slit 14, and in a section of the second nozzle member 12 that is cut in the length direction X of the slit 14, the dimension of each divided face 20 of the second nozzle member 12 is at least 1.5T2 or more where T2 is the thickness of the second nozzle member 12 in the width direction Z of the slit 14. The shape of each divided face 20 is not limited to the shapes illustrated in FIG. 4, FIG. 7, FIG. 8, FIG. 9, FIG. 10, FIG. 11, and FIG. 12.

The thickness of the flat plate portion 11*a* of the first nozzle member 11 and the thickness of the flat plate portion 12*a* of the second nozzle member 12 are set constant, but may be inconstant.

The upper limit of the dimension of the divided face 20 of the first nozzle member 11 is 5T1, and the upper limit of the dimension of the divided face 20 of the second nozzle member 12 is 5T2, but the upper limits may be more than 5T1 and 5T2, respectively.

All the first nozzle member 11, the second nozzle member 12, and the shim members 30 are made from a ceramic material, a carbon material, a carbon fiber-reinforced carbon composite material, or a ceramic-based composite material, but each of the first nozzle member 11, the second nozzle member 12, and the shim members 30 is not necessarily made from a ceramic material, a carbon material, a carbon fiber-reinforced carbon composite material, or a ceramic-based composite material.

All the first nozzle member 11, the second nozzle member 12, and the shim members are made from a ceramic material, a carbon material, a carbon fiber-reinforced carbon composite material, or a ceramic-based composite material, but all the first nozzle member 11, the second nozzle member 12, and the shim members are not necessarily made from the same material. However, all the first nozzle member 11, the second nozzle member 12, and the shim members are preferably made from the same material. This can certainly eliminate a difference in linear expansion coefficient among the first nozzle member 11, the second nozzle member 12, and the shim members.

Two independent shim members are not necessarily provided in the length direction X of the slit 14. For example, as long as a shim member is partly fitted in grooves of the first nozzle member 11 and grooves of the second nozzle member 12, the shim member may be an integral shim member having a connection part that connects portions fitted in the grooves of the nozzle members.

When pins 33 are used to connect the groove 28 of the first nozzle member 11 to the shim member 30 and to connect the groove 29 of the second nozzle member 12 to the shim member 30, the section of the groove 28, 29 is not limited to a rectangular shape but may be a dovetail groove shape, a T-groove shape, and other shapes. The sectional shape of the shim member 30 may be changed according to the sectional shape of the grooves 28, 29. The shape of the pin 33 is not necessarily a circular cylinder but may be a rectangular parallelepiped or other shapes.

EXAMPLES

A continuous hot-dip metal coating equipment 1 having the basic configuration illustrated in FIG. 1 was used to manufacture a hot-dip galvanized steel strip by introducing a steel strip S having a sheet thickness of 1.0 mm and a sheet width of 1,200 mm into a molten zinc bath at a sheet speed of 2.0 m/s. A gas wiping nozzle 10 has a slit 14 having a length L1 of 1,800 mm, a depth L2 of 20 mm, and a width (gap) L3 of 1.2 mm. The quotient of the dimension of a divided face 20 of nozzle members 11A to 11C, 12A to 12C divided by the nozzle thickness T is as illustrated in Table 1 over the entire dimension in the depth direction Y. During experiments, the molten zinc coating bath had a temperature of 460° C., and the gas temperature T was 500° C. at the tip of the wiping nozzle. The wiping gas used was a mixed and adjusted gas of a flue gas from a combustor with air. The molten zinc coating bath had a melting point $T_M$ of 420° C.

The gas wiping nozzles of Invention Examples 1 to 14 and Comparative Examples 1 to 5 will next be described.

In Invention Examples 1 to 14 and Comparative Examples 1 to 5, sialon had a flexural strength of 980 MPa, a Vickers hardness of 1,620 HV, a fracture toughness of 6 $MPa \cdot m^{1/2}$, a thermal shock resistance of 650° C., and a linear expansion coefficient of $3.2 \times 10^{-6}$/K. Chrome molybdenum steel had a yield stress of 400 MPa, a Vickers hardness of 300 HV, a fracture toughness of 236 $MPa \cdot m^{1/2}$, and a linear expansion coefficient of $11.2 \times 10^{-6}$/K.

Invention Example 1

In Invention Example 1, a first nozzle member 11, a second nozzle member 12, and shim members 30 made from sialon were used, and a nozzle header 15 made from chrome molybdenum steel was used. As illustrated in FIG. 4, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 4, the divided face 20 had a shape including a step 20*b*, in which D1 was 10 mm, D2 was 12 mm, and D3 was 10 mm. In a cut section, the first nozzle member 11 had a thickness T1 of 20 mm, and the second nozzle member 12 had a thickness T2 of 20 mm. The first nozzle member 11 and the second nozzle member 12 were each assembled. During the assembling, the adjacent nozzle members 11A and 11B, 11B and 11C, 12A and 12B, 12B and 12C were fixed with an adhesive mainly containing zirconia and silica. Next, the assembled first nozzle member 11 was placed at the upper side, and the assembled second nozzle member 12 was placed at the lower side. Substantially the same adhesive as above was applied to grooves 28 of the first nozzle member 11 and grooves 29 of the second nozzle member 12, and the shim members 30 having a rectangular parallelepiped shape were fitted into the grooves 28, 29 of the first nozzle member 11 and the second nozzle member 12. The nozzle header 15 was finally fixed to the first nozzle member 11 and the second nozzle member 12.

Invention Example 2

In Invention Example 2, a first nozzle member 11, a second nozzle member 12, and shim members 30 made from sialon were used, and a nozzle header 15 made from chrome molybdenum steel was used. As illustrated in FIG. 4, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 4, the divided face 20 had a shape including a step 20*b*, in which D1 was 10 mm, D2 was 78 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 3

In Invention Example 3, a first nozzle member 11, a second nozzle member 12, and shim members 30 made from sialon were used, and a nozzle header 15 made from chrome molybdenum steel was used. As illustrated in FIG. 7, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 7, the divided face 20 had a taper shape, in which E1 was 32 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 4

In Invention Example 4, a first nozzle member 11, a second nozzle member 12, and shim members 30 made from sialon were used, and a nozzle header 15 made from chrome molybdenum steel was used. As illustrated in FIG. 7, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 7, the divided face 20 had a taper shape, in which E1 was 98 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 5

In Invention Example 5, a first nozzle member 11, a second nozzle member 12, and shim members 30 made from sialon were used, and a nozzle header 15 made from chrome molybdenum steel was used. As illustrated in FIG. 13, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 13, the divided face 20 had a shape including a step 20*b*, in which D1 was 10 mm, D2 was 12 mm, and D3 was 10 mm. In a cut section, the first nozzle member 11 had a thickness T1 of 20 mm, and the second nozzle member 12 had a thickness T2 of 20 mm. Definitions of D1, D2, D3, and T are the same as in FIG. 4. Each divided face 20 of the first nozzle member 11 and the second nozzle member 12 was subjected to drilling at two points in the nozzle depth direction Y with a tolerance of 8 mm+10 μm. In the first nozzle member 11 and the second nozzle member 12, the adjacent nozzle members 11A and 11B, 11B and 11C, 12A and 12B, 12B and 12C were fixed on the divided faces 20 with an adhesive mainly containing zirconia and silica. Next, an adhesive mainly containing zirconia and silica was applied to the drilled portions, and two pins 32 prepared to have a diameter of 8 mm with a tolerance of −10 μm were inserted into the drilled portions arranged in the slit depth direction Y as illustrated in FIG. 13 and FIG. 15. Next, the shim members 30 having a rectangular parallelepiped shape were fitted into grooves 28, 29 of the first nozzle member 11 and the second nozzle member 12 through an adhesive mainly containing alumina and silica, and the nozzle header 15 was finally fixed to the first nozzle member 11 and the second nozzle member 12.

Invention Example 6

In Invention Example 6, a first nozzle member 11, a second nozzle member 12, and shim members 30 made from sialon were used, and a nozzle header 15 made from chrome molybdenum steel was used. As illustrated in FIG. 14, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 14, the divided face 20 had a taper shape, in which E1 was 32 mm. In a cut section, the first nozzle member 11 had a thickness T1 of 20 mm, and the second nozzle member 12 had a thickness T2 of 20 mm. Definitions of E1 and T are the same as in FIG. 7. Each divided face 20 of the first nozzle member 11 and the second nozzle member 12 was subjected to drilling at two points in the nozzle depth direction Y with a tolerance of 8 mm+10 μm. In the first nozzle member 11 and the second nozzle member 12, the adjacent nozzle members 11A and 11B, 11B and 11C, 12A and 12B, 12B and 12C were fixed on the divided faces 20 with an adhesive mainly containing zirconia and silica. Next, an adhesive mainly containing zirconia and silica was applied to the drilled portions, and two pins 32 prepared to have a diameter of 8 mm with a tolerance of −10 μm were inserted into the drilled portions arranged in the slit depth direction Y as illustrated in FIG. 14 and FIG. 15. Next, the shim members 30 having a rectangular parallelepiped shape were fitted into grooves 28, 29 of the first nozzle member 11 and the second nozzle member 12 through an adhesive mainly containing alumina and silica, and the nozzle header 15 was finally fixed to the first nozzle member 11 and the second nozzle member 12.

Invention Example 7

In Invention Example 7, a first nozzle member 11, a second nozzle member 12, and shim members 30 made from sialon were used, and a nozzle header 15 made from chrome molybdenum steel was used. As illustrated in FIG. 4, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 4, the divided face 20 had a shape including a step 20*b*, in which D1 was 10 mm, D2 was 82 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 8

In Invention Example 8, a first nozzle member 11, a second nozzle member 12, and shim members 30 made from sialon were used, and a nozzle header 15 made from chrome molybdenum steel was used. As illustrated in FIG. 7, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 7, the divided face 20 had a taper shape, in which E1 was 102 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 9

In Invention Example 9, a first nozzle member 11, a second nozzle member 12, and shim members 30 made from sialon were used, and a nozzle header 15 made from chrome molybdenum steel was used. As illustrated in FIG. 11, each of the first nozzle member 11 and the second nozzle member 12 was equally divided along the length direction X of the slit 14 into four nozzle members 11A, 11B, 11C, 11D, 12A, 12B, 12C, 12D (each nozzle member 11A, 11B, 11C, 11D, 12A, 12B, 12C, 12D had a length of 450 mm in the slit length direction X). As illustrated in FIG. 11, the divided face 20 had a shape including a step 20*b*, in which D1 was 10 mm, D2 was 12 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica.

The nozzle header 15 was then fixed to the first nozzle member 11 and the second nozzle member 12.

Invention Example 10

In Invention Example 10, a first nozzle member 11, a second nozzle member 12, and shim members 30 made from sialon were used, and a nozzle header 15 made from chrome molybdenum steel was used. As illustrated in FIG. 11, each of the first nozzle member 11 and the second nozzle member 12 was equally divided along the length direction X of the slit 14 into four nozzle members 11A, 11B, 11C, 11D, 12A, 12B, 12C, 12D (each nozzle member 11A, 11B, 11C, 11D, 12A, 12B, 12C, 12D had a length of 450 mm in the slit length direction X). As illustrated in FIG. 11, the divided face 20 had a shape including a step 20*b*, in which D1 was 10 mm, D2 was 78 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 11

In Invention Example 11, a first nozzle member 11, a second nozzle member 12, and shim members 30 made from sialon were used, and a nozzle header 15 made from chrome molybdenum steel was used. As illustrated in FIG. 11, each of the first nozzle member 11 and the second nozzle member 12 was equally divided along the length direction X of the slit 14 into four nozzle members 11A, 11B, 11C, 11D, 12A, 12B, 12C, 12D (each nozzle member 11A, 11B, 11C, 11D, 12A, 12B, 12C, 12D had a length of 450 mm in the slit length direction X). As illustrated in FIG. 11, the divided face 20 had a shape including a step 20*b*, in which D1 was 10 mm, D2 was 82 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 12

Figure 12:
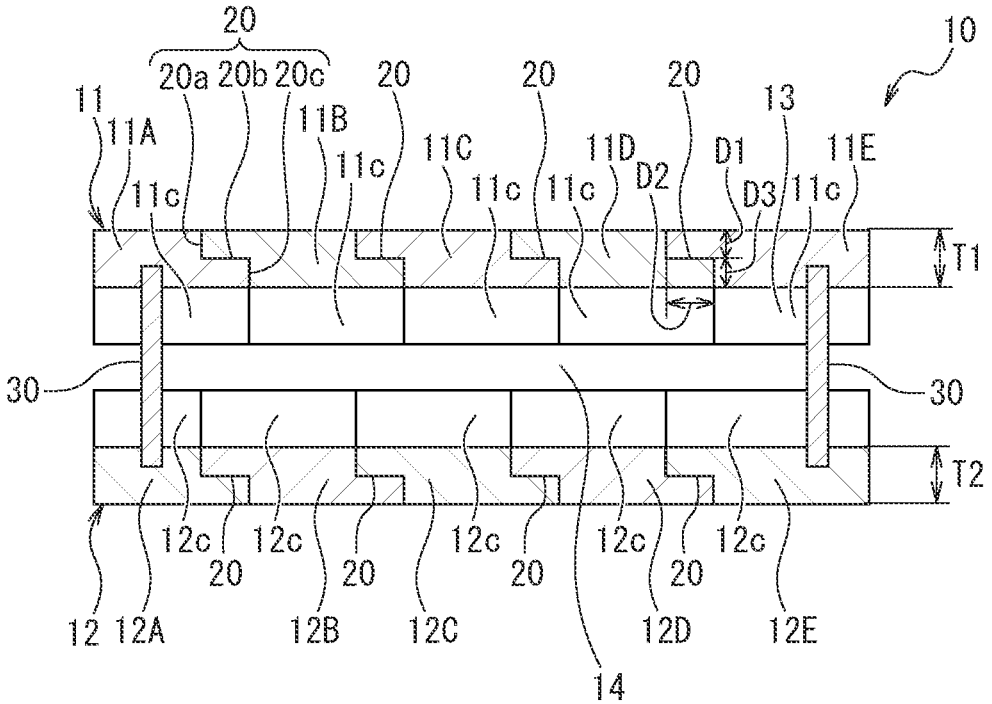
FIG. 12 is a sectional view of a gas wiping nozzle pertaining to a sixth alternative embodiment, similar to FIG. 4.

In Invention Example 12, a first nozzle member 11, a second nozzle member 12, and shim members 30 made from sialon were used, and a nozzle header 15 made from chrome molybdenum steel was used. As illustrated in FIG. 12, each of the first nozzle member 11 and the second nozzle member 12 was equally divided along the length direction X of the slit 14 into five nozzle members 11A, 11B, 11C, 11D, 11E, 12A, 12B, 12C, 12D, 12E (each nozzle member 11A, 11B, 11C, 11D, 11E, 12A, 12B, 12C, 12D, 12E had a length of 450 mm in the slit length direction X). As illustrated in FIG. 12, the divided face 20 had a shape including a step 20*b*, in which D1 was 10 mm, D2 was 12 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 13

In Invention Example 13, a first nozzle member 11, a second nozzle member 12, and shim members 30 made from sialon were used, and a nozzle header 15 made from chrome molybdenum steel was used. As illustrated in FIG. 12, each of the first nozzle member 11 and the second nozzle member 12 was equally divided along the length direction X of the slit 14 into five nozzle members 11A, 11B, 11C, 11D, 11E, 12A, 12B, 12C, 12D, 12E (each nozzle member 11A, 11B, 11C, 11D, 11E, 12A, 12B, 12C, 12D, 12E had a length of 450 mm in the slit length direction X). As illustrated in FIG. 12, the divided face 20 had a shape including a step 20*b*, in which D1 was 10 mm, D2 was 78 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Invention Example 14

In Invention Example 14, a first nozzle member 11, a second nozzle member 12, and shim members 30 made from sialon were used, and a nozzle header 15 made from chrome molybdenum steel was used. As illustrated in FIG. 12, each of the first nozzle member 11 and the second nozzle member 12 was equally divided along the length direction X of the slit 14 into five nozzle members 11A, 11B, 11C, 11D, 11E, 12A, 12B, 12C, 12D, 12E (each nozzle member 11A, 11B, 11C, 11D, 11E, 12A, 12B, 12C, 12D, 12E had a length of 450 mm in the slit length direction X). As illustrated in FIG. 12, the divided face 20 had a shape including a step 20*b*, in which D1 was 10 mm, D2 was 82 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Comparative Example 1

In Comparative Example 1, a first nozzle member 11, a second nozzle member 12, and shim members 30 made from sialon were used, and a nozzle header 15 made from chrome molybdenum steel was used. As illustrated in FIG. 5, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 5, the divided face 20 had a linear shape parallel with the nozzle thickness direction, and each divided face 20 had a dimension of 20 mm, which was the same as the thickness T1 of the first nozzle member 11 and the thickness T2 of the second nozzle member 12. The first nozzle member 11 and the second nozzle member 12 were each assembled with an adhesive mainly containing alumina and silica, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Comparative Example 2

In Comparative Example 2, a first nozzle member 11, a second nozzle member 12, and shim members 30 made from sialon were used, and a nozzle header 15 made from chrome molybdenum steel was used. As illustrated in FIG. 4, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 4, the divided face 20 had a shape including a step 20*b*, in which D1 was 10 mm, D2 was 8 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Comparative Example 3

In Comparative Example 3, a first nozzle member 11, a second nozzle member 12, and shim members 30 made from sialon were used, and a nozzle header 15 made from chrome molybdenum steel was used. As illustrated in FIG. 7, each of the first nozzle member 11 and the second nozzle member 12 was equally divided along the length direction X of the slit 14 into three nozzle members 11A, 11B, 11C, 12A, 12B, 12C (each nozzle member 11A, 11B, 11C, 12A, 12B, 12C had a length of 600 mm in the slit length direction X). As illustrated in FIG. 7, the divided face 20 had a taper shape, in which E1 was 28 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Comparative Example 4

In Comparative Example 4, a first nozzle member 11, a second nozzle member 12, and shim members 30 made from sialon were used, and a nozzle header 15 made from chrome molybdenum steel was used. As illustrated in FIG. 11, each of the first nozzle member 11 and the second nozzle member 12 was equally divided along the length direction X of the slit 14 into four nozzle members 11A, 11B, 11C, 11D, 12A, 12B, 12C, 12D (each nozzle member 11A, 11B, 11C, 11D, 12A, 12B, 12C, 12D had a length of 450 mm in the slit length direction X). As illustrated in FIG. 11, the divided face 20 had a shape including a step 20*b*, in which D1 was 10 mm, D2 was 8 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

Comparative Example 5

In Comparative Example 5, a first nozzle member 11, a second nozzle member 12, and shim members 30 made from sialon were used, and a nozzle header 15 made from chrome molybdenum steel was used. As illustrated in FIG. 12, each of the first nozzle member 11 and the second nozzle member 12 was equally divided along the length direction X of the slit 14 into five nozzle members 11A, 11B, 11C, 11D, 11E, 12A, 12B, 12C, 12D, 12E (each nozzle member 11A, 11B, 11C, 11D, 11E, 12A, 12B, 12C, 12D, 12E had a length of 450 mm in the slit length direction X). As illustrated in FIG. 12, the divided face 20 had a shape including a step 20*b*, in which D1 was 10 mm, D2 was 8 mm, and D3 was 10 mm. In a cut section, the first nozzle member 11 had a thickness T1 of 20 mm, and the second nozzle member 12 had a thickness T2 of 20 mm. In a similar manner to that in Invention Example 1, the first nozzle member 11 and the second nozzle member 12 were each assembled, and the shim members 30 having a rectangular parallelepiped shape were fitted into grooves 28, 29 of the first nozzle member 11 and the second nozzle member 12 through an adhesive mainly containing alumina and silica. The nozzle header 15 was then fixed to the first nozzle member 11 and the second nozzle member 12.

In Invention Examples 1 to 14 and Comparative Examples 1 to 5, the rate of the gap change of the slit 14, the coating amount deviation on a steel strip S in the width direction, the occurrence rate of linear marks, and nozzle breakage (cracks) were evaluated. In the evaluation, the rate (%) of the gap change of the slit 14 is a value (%) expressed by the maximum gap in the length direction X of the slit 14/the minimum gap×100, and a nozzle having a rate of less than 110(%) is acceptance. The coating amount deviation (%) on a steel strip Sin the width direction is a value (T) expressed by the maximum coating amount on a steel strip S in the width direction/the minimum coating amount×100, and a nozzle giving a deviation of less than 120(%) is acceptance. The occurrence rate (%) of linear marks is the rate of the length of a steel strip S in which a linear mark defect was visually identified in an inspection process to the length of a steel strip S manufactured in each condition, and a nozzle giving a rate of less than 0.4(%) is acceptance.

The results are illustrated in Table 1.

TABLE 1

| | Nozzle thickness T, mm | Divided face shape | Divided face dimension, mm | Divided face dimension/nozzle thickness, — | Presence or absence of pins |
|---|---|---|---|---|---|
| Invention Example 1 | 20 | Step | 32 | 1.6 | Absence |
| Invention Example 2 | 20 | Step | 98 | 4.9 | Absence |
| Invention Example 3 | 20 | Taper | 32 | 1.6 | Absence |
| Invention Example 4 | 20 | Taper | 98 | 4.9 | Absence |
| Invention Example 5 | 20 | Step | 32 | 1.6 | Presence |
| Invention Example 6 | 20 | Taper | 32 | 1.6 | Presence |
| Invention Example 7 | 20 | Step | 102 | 5.1 | Absence |
| Invention Example 8 | 20 | Taper | 102 | 5.1 | Absence |
| Invention Example 9 | 20 | Step | 32 | 1.6 | Absence |
| Invention Example 10 | 20 | Step | 98 | 4.9 | Absence |
| Invention Example 11 | 20 | Step | 102 | 5.1 | Absence |
| Invention Example 12 | 20 | Step | 32 | 1.6 | Absence |
| Invention Example 13 | 20 | Step | 98 | 4.9 | Absence |
| Invention Example 14 | 20 | Step | 102 | 5.1 | Absence |
| Comparative Example 1 | 20 | Straight | 20 | 1 | Absence |
| Comparative Example 2 | 20 | Step | 28 | 1.4 | Absence |
| Comparative Example 3 | 20 | Taper | 28 | 1.4 | Absence |
| Comparative Example 4 | 20 | Step | 28 | 1.4 | Absence |
| Comparative Example 5 | 20 | Step | 28 | 1.4 | Absence |

| | Rate of gap change, % | Coating amount deviation in width direction, % | Occurrence rate of linear marks, % | Cracks | |
|---|---|---|---|---|---|
| Invention Example 1 | 108 | 119 | 0.39 | Not observed | |
| Invention Example 2 | 102 | 110 | 0.28 | Not observed | |
| Invention Example 3 | 109 | 117 | 0.38 | Not observed | |
| Invention Example 4 | 103 | 112 | 0.30 | Not observed | |
| Invention Example 5 | 106 | 116 | 0.35 | Not observed | |
| Invention Example 6 | 107 | 115 | 0.37 | Not observed | |
| Invention Example 7 | 103 | 112 | 0.30 | Observed | |
| Invention Example 8 | 104 | 113 | 0.32 | Observed | |
| Invention Example 9 | 108 | 119 | 0.39 | Not observed | Divided into four |
| Invention Example 10 | 102 | 110 | 0.28 | Not observed | |
| Invention Example 11 | 103 | 112 | 0.30 | Observed | |
| Invention Example 12 | 108 | 119 | 0.39 | Not observed | Divided into five |
| Invention Example 13 | 102 | 110 | 0.28 | Not observed | |
| Invention Example 14 | 104 | 113 | 0.32 | Observed | |
| Comparative Example 1 | 172 | 201 | 1.50 | Not observed | |
| Comparative Example 2 | 115 | 129 | 0.52 | Not observed | |
| Comparative Example 3 | 118 | 134 | 0.57 | Not observed | |
| Comparative Example 4 | 115 | 129 | 0.52 | Not observed | Divided into four |
| Comparative Example 5 | 115 | 129 | 0.52 | Not observed | Divided into five |

As apparent from Table 1, in Invention Examples 1 to 14 in which the divided face had a dimension of 1.5T or more, the rate of the gap change of the slit 14, the coating amount deviation on a steel strip S in the width direction, and the occurrence rate of linear marks were significantly reduced as compared with Comparative Examples 1 to 5 in which the divided face had a dimension of 1 to 1.4T, and each nozzle in Invention Examples was acceptance.

In Comparative Example 1 in which the divided face had a linear shape parallel with the nozzle thickness direction, and the divided face had a dimension of 1T, in Comparative Examples 2, 4, and 5 in which the divided face had a shape including a step, but the divided face had a dimension of 1.4T, and in Comparative Example 3 in which the divided face had a taper shape, but the divided face had a dimension of 1.4T, each of the rate of the gap change of the slit 14, the coating amount deviation on a steel strip S in the width direction, and the occurrence rate of linear marks was more than the acceptance standard, and each nozzle was failure.

In Invention Examples 7, 8, 11, and 14, the divided face had a dimension of more than 5T, and cracks were observed on each of the first nozzle member 11 and the second nozzle member 12 in nozzle overhaul inspection after manufacture, but the rate of the gap change of the slit 14, the coating amount deviation on a steel strip S in the width direction, and the occurrence rate of linear marks satisfied the acceptance standards, and each nozzle was acceptance.

In each of Invention Examples 1 to 14 and Comparative Examples 1 to 5, the temperature of the wiping gas is controlled so that the temperature T (° C.) of the wiping gas immediately after being blown from the slit 14 of the gas wiping nozzle 10 satisfies $T_M-150 \leq T \leq T_M+250$ in relation to the melting point $T_M$ (° C.) of the molten metal. Hence, no hot metal wrinkle defect was observed in each of Invention Examples 1 to 14 and Comparative Examples 1 to 5.

The above results reveal that, by using the gas wiping nozzle and the method for manufacturing the hot-dip metal coated metal strip pertaining to the present invention, in which the gas wiping nozzle is manufactured from members divided along the length direction X of the slit 14 as a gas blowing port, the gap L3 in the width direction Z orthogonal to the length direction X of the slit 14 can be maintained to be constant over the length direction X of the slit 14 even in a high temperature atmosphere, and the coating amount on a steel strip S can be uniformized in the width direction of the steel strip S.

REFERENCE SIGNS LIST

1 continuous hot-dip metal coating equipment
2 snout
3 coating tank
4 molten metal bath
5 sink roll
6 support roll
10 gas wiping nozzle
11 first nozzle member
11A, 11B, 11C, 11D, 11E nozzle member
11*a* flat plate portion
11*b* flange portion
11*c* inclined end portion
12 second nozzle member
12A, 12B, 12C, 12D, 12E nozzle member
12*a* flat plate portion
12*b* flange portion
12*c* inclined end portion
13 hollow portion
13*a* hollow portion-forming space
13*b* hollow portion-forming space
14 slit
15 nozzle header
16 gas supply path
17 gas supply pipe
20 divided face
20*a* first linear portion
20*b* step
20*c* second linear portion
20*d* concave face
20*e* convex face
28, 29 groove
28*a*, 29*a* corner shim member
31 slippage
32 pin
33 pin
L1 slit length
L2 slit depth
L3 slit width (slit gap)
S steel strip (metal band)
X slit length direction (steel strip width direction)
Y slit depth direction (steel strip thickness direction)
Z slit width direction (steel strip length direction)

The invention claimed is:

1. A gas wiping nozzle configured to blow a wiping gas onto a metal strip pulled up from a molten metal bath and adjust an amount of a molten metal coated to a surface of the metal strip, the gas wiping nozzle comprising:

a first nozzle member; and a second nozzle member, wherein the gas wiping nozzle has a slit as a gas blowing port between the first nozzle member and the second nozzle member, at a metal strip-side end of the gas wiping nozzle, each of the first nozzle member and the second nozzle member is divided along a length direction of the slit into a plurality of nozzle members, a dimension of a divided face of the first nozzle member is 1.5T1 or more in a section of the first nozzle member that is cut in the length direction of the slit, at at least one point on a depth direction orthogonal to the length direction of the slit where T1 is a thickness of the first nozzle member in a width direction of the slit, and a dimension of a divided face of the second nozzle member is 1.5T2 or more in a section of the second nozzle member that is cut in the length direction of the slit, at at least one point on the depth direction orthogonal to the length direction of the slit where T2 is a thickness of the second nozzle member in the width direction of the slit.

2. The gas wiping nozzle according to claim 1, further comprising a shim member adjusting a gap of the slit in the width direction orthogonal to the length direction.

3. The gas wiping nozzle according to claim 2, wherein a region in the depth direction in which the dimension of the divided face of the first nozzle member is 1.5T1 or more is a region having a dimension of not less than ⅓ of a full dimension in the depth direction of the first nozzle member, and a region in the depth direction in which the dimension of the divided face of the second nozzle member is 1.5T2 or more is a region having a dimension of not less than ⅓ of a full dimension in the depth direction of the second nozzle member.

4. The gas wiping nozzle according to claim 3, wherein an upper limit of the dimension of the divided face of the first nozzle member is 5T1, and an upper limit of the dimension of the divided face of the second nozzle member is 5T2.

5. The gas wiping nozzle according to claim 4, wherein the first nozzle member, the second nozzle member, and the shim member are made from a ceramic material, a carbon material, carbon a fiber-reinforced carbon composite material, or a ceramic-based composite material.

6. The gas wiping nozzle according to claim 3, wherein the first nozzle member, the second nozzle member, and the shim member are made from a ceramic material, a carbon material, carbon a fiber-reinforced carbon composite material, or a ceramic-based composite material.

7. The gas wiping nozzle according to claim 2, wherein an upper limit of the dimension of the divided face of the first nozzle member is 5T1, and an upper limit of the dimension of the divided face of the second nozzle member is 5T2.

8. The gas wiping nozzle according to claim 7, wherein the first nozzle member, the second nozzle member, and the shim member are made from a ceramic material, a carbon material, carbon a fiber-reinforced carbon composite material, or a ceramic-based composite material.

9. The gas wiping nozzle according to claim 1, wherein a region in the depth direction in which the dimension of the divided face of the first nozzle member is 1.5T1 or more is a region having a dimension of not less than ⅓ of a full dimension in the depth direction of the first nozzle member, and a region in the depth direction in which the dimension of the divided face of the second nozzle member is 1.5T2 or more is a region having a dimension of not less than ⅓ of a full dimension in the depth direction of the second nozzle member.

10. The gas wiping nozzle according to claim 9, wherein an upper limit of the dimension of the divided face of the first nozzle member is 5T1, and an upper limit of the dimension of the divided face of the second nozzle member is 5T2.

11. The gas wiping nozzle according to claim 1, wherein an upper limit of the dimension of the divided face of the first nozzle member is 5T1, and an upper limit of the dimension of the divided face of the second nozzle member is 5T2.

12. The gas wiping nozzle according to claim 1, wherein each divided face of the first nozzle member and the second nozzle member has a shape including a step.

13. The gas wiping nozzle according to claim 1, wherein each divided face of the first nozzle member and the second nozzle member has a taper shape that inclines with respect to the width direction of the slit.

14. The gas wiping nozzle according to claim 1, wherein each divided face of the first nozzle member and the second nozzle member has a fitting face shape such that a concave face and a convex face of adjacent divided nozzle members fit together.

15. The gas wiping nozzle according to claim 1, wherein the first nozzle member, the second nozzle member, and the shim member are made from a ceramic material, a carbon material, carbon a fiber-reinforced carbon composite material, or a ceramic-based composite material.

16. The gas wiping nozzle according to claim 1, wherein divided nozzle members of the first nozzle member are connected with a pin, and divided nozzle members of the second nozzle member are connected with a pin.

17. A method for manufacturing a hot-dip metal coated metal strip, the method comprising:

placing a pair of the gas wiping nozzles according to claim 1 at respective sides of a metal strip pulled up from a molten metal bath; and blowing wiping gas from each slit of the pair of gas wiping nozzles to each surface of the metal strip to adjust an amount of molten metal coated to both surfaces of the metal strip, continuously manufacturing a hot-dip metal coated metal strip.

* * * * *